US010883806B2

(12) United States Patent
Bednar et al.

(10) Patent No.: US 10,883,806 B2
(45) Date of Patent: Jan. 5, 2021

(54) METHOD AND APPARATUS FOR ALIGNING ARROW NOCKS

(71) Applicant: Hunter's Manufacturing Company, Inc., Suffield, OH (US)

(72) Inventors: Richard L. Bednar, Munroe Falls, OH (US); Michael J. Shaffer, Mogadore, OH (US); Jacob A. Hout, Akron, OH (US); Dean Mook, Akron, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 16/459,666

(22) Filed: Jul. 2, 2019

(65) Prior Publication Data

US 2019/0323806 A1 Oct. 24, 2019

Related U.S. Application Data

(63) Continuation of application No. 16/173,042, filed on Oct. 29, 2018, now Pat. No. 10,393,484, which is a continuation of application No. 15/833,440, filed on Dec. 6, 2017, now Pat. No. 10,119,796, which is a continuation of application No. 15/643,056, filed on Jul. 6, 2017, now Pat. No. 10,030,948, which is a continuation of application No. 15/276,375, filed on Sep. 26, 2016, now Pat. No. 9,759,513, which is a continuation-in-part of application No. 14/729,098, filed on Jun. 3, 2015, now Pat. No. 9,453,700, which is a continuation-in-part of application No. 14/091,855, filed on Nov. 27, 2013, now Pat. No. 9,470,486, which is a continuation of application No. 14/075,244, filed on Nov. 8, 2013, now Pat. No. 9,074,837, said application No. 15/643,056 is a (Continued)

(51) Int. Cl.
*F42B 6/06* (2006.01)

(52) U.S. Cl.
CPC ..... *F42B 6/06* (2013.01)

(58) Field of Classification Search
CPC ..... F42B 6/06
USPC ..... 473/578
See application file for complete search history.

(56) References Cited

U.S. PATENT DOCUMENTS 2,209,672 A 7/1940 Boggs
2,484,589 A 10/1949 Richards
(Continued)

FOREIGN PATENT DOCUMENTS

KR 10-2010-0138335 12/2010

OTHER PUBLICATIONS

Canadian Office Action for CA Application No. 2,795,149 for "Nock Device for Bow".

(Continued)

*Primary Examiner* — Alexander R Niconovich
(74) *Attorney, Agent, or Firm* — Emerson Thomson Bennett, LLC

(57) ABSTRACT

An arrow nock may have at least two distinct string guide impressions each designed to receive a bowstring to fire an arrow from a bow. The nock may be operable when connected and aligned with the arrow to cause the bowstring to be received within at least one of the string guide impressions to fire the arrow. As it is received within the string guide impression, the bowstring may cause the arrow to rotate about its longitudinal axis.

13 Claims, 34 Drawing Sheets

Related U.S. Application Data continuation-in-part of application No. 13/669,833, filed on Nov. 6, 2012, now Pat. No. 8,622,855.

(60) Provisional application No. 61/846,141, filed on Jul. 15, 2013, provisional application No. 61/556,527, filed on Nov. 7, 2011.

(56) References Cited

U.S. PATENT DOCUMENTS 3,034,789 A 5/1962 Moore
3,214,174 A 10/1965 Saunders
3,658,335 A 4/1972 Saunders
4,305,588 A 12/1981 Dodge
4,544,163 A 10/1985 Scanlon
4,656,994 A 4/1987 Jenks
4,874,180 A 10/1989 Fingerson et al.
4,943,067 A 7/1990 Saunders
5,067,731 A 11/1991 Bickel
5,154,432 A 10/1992 Saunders
5,186,470 A 2/1993 Easton et al.
5,306,019 A 4/1994 Guest et al.
5,306,020 A 4/1994 Bolf
5,417,439 A 5/1995 Bickel
5,423,553 A 6/1995 Krieg
5,439,231 A 8/1995 Roberts et al.
5,465,979 A * 11/1995 Buhler ..... F42B 6/06 473/578
5,803,843 A 9/1998 Anderson et al.
5,919,105 A 7/1999 Summers
5,987,724 A 11/1999 Kleman
6,203,457 B1 * 3/2001 Snook ..... F42B 6/06 473/586
6,364,499 B1 4/2002 Jones
6,669,585 B2 12/2003 Sutherland et al.
7,189,170 B1 3/2007 Korsa et al.
7,922,609 B1 4/2011 Hajari
7,931,550 B2 4/2011 Lynch
8,038,552 B2 10/2011 Song
8,257,208 B2 9/2012 Harding
8,622,855 B2 1/2014 Bednar
8,845,464 B1 * 9/2014 Hyde ..... F42B 6/06 473/586
8,944,944 B2 * 2/2015 Pedersen ..... F42B 12/382 473/578
9,028,347 B2 * 5/2015 Pedersen ..... F21V 33/008 473/578
9,074,837 B2 * 7/2015 Bednar ..... F41B 5/148
9,140,527 B2 * 9/2015 Pedersen ..... F42B 6/06
9,243,875 B2 1/2016 Minica
9,285,195 B1 * 3/2016 Palomaki ..... F42B 6/06
9,383,177 B1 * 7/2016 Kallmes ..... F42B 10/02
9,441,925 B1 * 9/2016 Palomaki ..... F42B 6/06
9,453,700 B2 9/2016 Bednar et al.
9,470,486 B2 10/2016 Bednar et al.
9,714,818 B2 * 7/2017 Mook ..... F42B 6/06
9,746,294 B2 8/2017 Palomaki
9,759,513 B2 9/2017 Bednar et al.
10,234,251 B2 * 3/2019 Ans ..... F42B 6/06
2013/0116071 A1 * 5/2013 Bednar ..... F41B 5/1415 473/578
2017/0010082 A1 * 1/2017 Bednar ..... F42B 6/06

OTHER PUBLICATIONS

European Search Report for European Application No. 12 19 1687.8 "Nock Device for Bow," dated Nov. 11, 2014.
English Translation of KR 10-2010-0138335, Nock With a Plurality of Circumferential Grooves.

* cited by examiner

METHOD AND APPARATUS FOR ALIGNING ARROW NOCKS

This application is a continuation of U.S. patent application Ser. No. 16/173,042 filed Oct. 29, 2018 entitled METHOD AND APPARATUS FOR ALIGNING ARROW NOCK, which is a continuation of U.S. patent application Ser. No. 15/833,440 filed Dec. 6, 2017 entitled METHOD AND APPARATUS FOR ALIGNING ARROW NOCKS, which is a continuation of U.S. patent application Ser. No. 15/643,056 filed Jul. 6, 2017 entitled METHOD AND APPARATUS FOR ALIGNING ARROW NOCKS, which is a continuation of U.S. patent application Ser. No. 15/276,375 filed Sep. 26, 2016 entitled METHOD AND APPARATUS FOR ALIGNING ARROW NOCKS, which is a continuation-in-part of U.S. patent application Ser. No. 14/729,098 filed Jun. 3, 2015 entitled METHOD AND APPARATUS FOR ALIGNING ARROW NOCKS, which is a continuation-in-part of U.S. patent application Ser. No. 14/091,855 filed Nov. 27, 2013 entitled NOCK DEVICE FOR BOW, which is a continuation of U.S. patent application Ser. No. 14/075,244 filed Nov. 8, 2013 entitled METHOD AND APPARATUS FOR ALIGNING ARROW NOCKS, which claims the benefit of U.S. Provisional Patent Application No. 61/846,141 filed Jul. 15, 2013 entitled METHOD AND APPARATUS FOR ALIGNING ARROW NOCKS. U.S. patent application Ser. No. 15/643,056 is also a continuation-in-part of U.S. patent application Ser. No. 13/669,833 filed Nov. 6, 2012 entitled NOCK DEVICE FOR BOW, which claims the benefit of U.S. Provisional Patent Application No. 61/556,527 filed Nov. 7, 2011 entitled NOCK DEVICE FOR BOW.

I. BACKGROUND

A. Field of the Invention

This invention relates generally to arrows that are shot or fired by bows, crossbows and the like. More particularly, this invention relates to methods and apparatuses used to align arrow nocks to arrows and arrows to crossbows.

B. Description of Related Art

In the sport of archery it is well known to provide a so-called nock at the back end of the arrow, which, in essence is a slot, or other means, to engage the bowstring of a bow during the draw. It is also well known that in order to perform a good aim and subsequent shot of the arrow the nock should be placed on the bow string at a point close to the center of the bowstring and that said point should also be aligned horizontally with a point at which the arrow is supported at the center of the bow. In order to attain such alignment, it is known to provide a so-called center nock attached to the center of the bowstring, which may engage the rear end of the arrow, while it is being driven by the bowstring toward the target.

FIG. 1 is a component diagram illustrating a perspective view of an example implementation 1300 of a nock. In the example implementation 1300, a flat nock 30 does not comprise an obvious slot or groove, but merely comprises a flat portion 32 and a shaft engagement portion 34. In this implementation, for example, a user may engage the bowstring to the flat portion 32 of the flat nock 30 at any suitable location on the flat portion 32. Further, in this example, attachment surface 34 may be a shaft engagement portion configured to suitably fit into an end of an arrow shaft (not shown). The flat nock 30 may allow various orientations of the arrow against the bowstring, merely dependent upon how the user decides to align the nock 30 on the bowstring. However, the configuration of the flat portion 32 of the flat nock 30 may not provide for a way of appropriately centering the bowstring on the flat portion 32. That is, for example, while the orientation of the flat nock 30 is not limited by a slot or groove, thereby allowing various alignments of the arrow's fletching vanes, the center alignment of the bowstring on the nock cannot be assured.

FIGS. 2A and 2B are component diagrams illustrating a rear perspective view of example implementations 1350, 1375 of a portion of an arrow. In the example implementation 1350, an arrow shaft 40 comprises an alignment groove/slot 44 (e.g., comprised on the nock), which is oriented in an up position. In this position, the fletching vanes 42 attached to the arrow shaft 40 can be aligned in the first position, for example, where vane 42*b* protrudes to the right at approximately ninety degrees from the orientation of the groove 44, and vanes 42*a* and 42*c* protrude to the left at approximately thirty degrees and one-hundred and fifty degrees, respectively, from the orientation of the groove 44 (e.g., respective vanes aligned approximately one-hundred and twenty degrees apart).

In the example implementation 1375, the arrow shaft 40 may be rotated one-hundred and eighty degrees (e.g., flipped over), where the alignment groove 44 is oriented in a down position. In this implementation 1375, the respective alignment of the vanes 42 has changed to a second position, placing them in an opposite position relative to the up orientation of the example implementation 1350. In this way, for example, the dual orientation of the slotted nock may accommodate both right-handed and left-handed vertical bow shooters. The slotted nock can accommodate merely one appropriate position on a crossbow barrel, as illustrated in FIG. 2C, where, in the example implementation 1380, the vane 42*b* may be disposed in a barrel slot of the crossbow (e.g., proper operational position). In this example implementation 1380, placing either vane 42*a* or 42*b* in the downward position (e.g., in the barrel slot) may not allow for proper alignment of the groove 44 with a crossbow bowstring. The slotted nock is merely limited to these two orientations, for example, where merely one orientation (e.g., 1350) may be used in a crossbow.

FIG. 3 shows a known arrow 1210 that may be shot or fired by a bow, a crossbow or other such device (hereinafter any and all devices that can propel or fire an arrow will be referred to as a "bow" unless specified otherwise). The arrow 1210 may include a body 1212 with an arrow head 1214 positioned at the front end of the body 1212 and three fletchings or vanes 1216 positioned near the back end of the body 1212. The arrow head 1214 is the portion that strikes a target when the arrow 1210 is shot. The vanes 1216 act as airfoils and stabilize the arrow 1210 when it is in flight. A nock 1218 may be positioned at the back end of the arrow 1210. The nock 1218 has one end with an extension that is received in an opening in the arrow body 1212. At the opposite end, the nock 1218 has a head with a bowstring reception surface, typically in the form of a groove, which receives the bowstring on the bow that propels the arrow 1210. More recently, it is known to provide arrows with lighted nocks. By "lighted" it is meant that a light source illuminates the nock so that the user can see the nock, and thus the arrow, after the arrow has been shot.

A known problem is properly aligning the nock, lighted or otherwise, with respect to the arrow. If the nock is not properly aligned, one or more of the vanes may contact the bow as the arrow is shot, decreasing the force and accuracy of the shot arrow. Misalignment may also prevent the nock from effectively engaging the bowstring. That is, for example, a groove in the nock may not lie along the bowstring properly.

To assist with nock alignment, it is known to provide nocks with a tab or ridge on the head and to provide the arrow with an index or cock vane. Typically the index vane is provided with a unique color and thus is easily identified. To align the nock, the user inserts the extension of the nock into the arrow opening and then rotates the nock with his/her fingers with respect to the arrow until the tab is aligned with respect to the index vane. While the use of such nock tabs assist with alignment, they do not provide the precise alignment desired unless the user spends considerable time carefully rotating the nock while "eyeing" the relative position of the tab with the index vane.

What is needed is a nock that provides effective alignment of the arrow with respect to the crossbow and a tool to improve both the speed and accuracy of nock alignment with respect to an arrow.

II. SUMMARY OF THE INVENTION

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

According to some implementations of this invention, a method may comprise the steps of: (A) providing a nock with: (1) a circumference; (2) an attachment surface; and (3) a top portion having an axial centerline and first, second and third distinct string guide impressions; (B) providing each string guide impression with two circumferentially spaced walls separated by a floor that is curvilinear in shape; (C) providing each wall with: (1) an axially extending peak that is curvilinear in shape; and (2) first and second circumferentially spaced sides that are curvilinear in shape; (D) providing the nock to be useful with an associated arrow having a longitudinal axis and an associated bow having a bowstring; and (E) providing the nock to be operable to perform the following steps: (1) connecting the attachment surface to the associated arrow and aligning the nock with respect to the associated arrow; and (2) contacting the associated bowstring to any surface on the top portion of the nock. Step (E)(2) may comprise the steps of: (1) contacting a curvilinear surface of the nock with the associated bowstring; and (2) positioning the associated bowstring within at least one of the string guide impressions to fire the associated arrow.

According to some implementations of this invention, a method may comprise the steps of: (A) providing a nock with: (1) a circumference; (2) an attachment surface; and (3) a top portion having an axial centerline and first, second and third distinct string guide impressions; (B) providing each string guide impression with two circumferentially spaced walls separated by a floor; (C) providing each wall with: (1) an axially extending peak; and (2) first and second circumferentially spaced sides that are curvilinear in shape; (D) providing the nock to be useful with an associated arrow having a longitudinal axis and an associated bow having a bowstring with a circular cross-section; and (E) providing the nock to be operable to perform the following steps: (1) connecting the attachment surface to the associated arrow and aligning the nock with respect to the associated arrow; and (2) receiving a portion of the associated bowstring within at least one of the string guide impressions to fire the associated arrow. Step (E)(2) may comprise the steps of: (1) contacting the corresponding floor with the associated bowstring; and (2) simultaneously extending the associated bowstring axially beyond the corresponding wall peaks.

According to some implementations of this invention, a method may comprise the steps of: (A) providing a nock with: (1) an attachment surface; and (2) a top portion having first and second distinct string guide impressions; (B) providing the nock to be useful with an associated arrow having a longitudinal axis and an associated bow that: (1) has a bowstring; and (2) is designed to receive the associated arrow for firing in a limited number of alignment orientations; and (C) providing the nock to be operable to perform the following steps: (1) connecting the attachment surface to the associated arrow and aligning the nock with respect to the associated arrow; (2) contacting the associated bowstring to the top portion of the nock; and (3) receiving a portion of the associated bowstring within at least one of the string guide impressions to fire the associated arrow. Steps (C)(2) and (C)(3) may comprise the step of: rotating the associated arrow about its longitudinal axis with respect to the associated bow to prevent the associated arrow from remaining in any orientation other than one of the limited number of alignment orientations.

III. BRIEF DESCRIPTION OF THE DRAWINGS

The invention may take physical form in certain parts and arrangement of parts, implementations of which will be described in detail in this specification and illustrated in the accompanying drawings which form a part hereof and wherein:

FIG. 29 is an end view of the alignment tool taken along line 29-29 in

FIG. 26.

Figure 30:
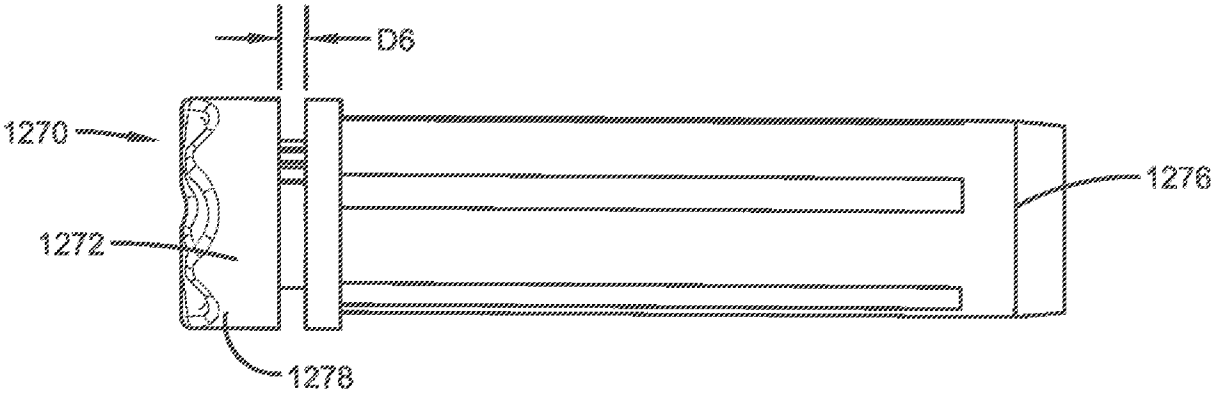

FIG. 30 is a side view of a lighted nock assembly according to some embodiments of this invention.

Figure 31:
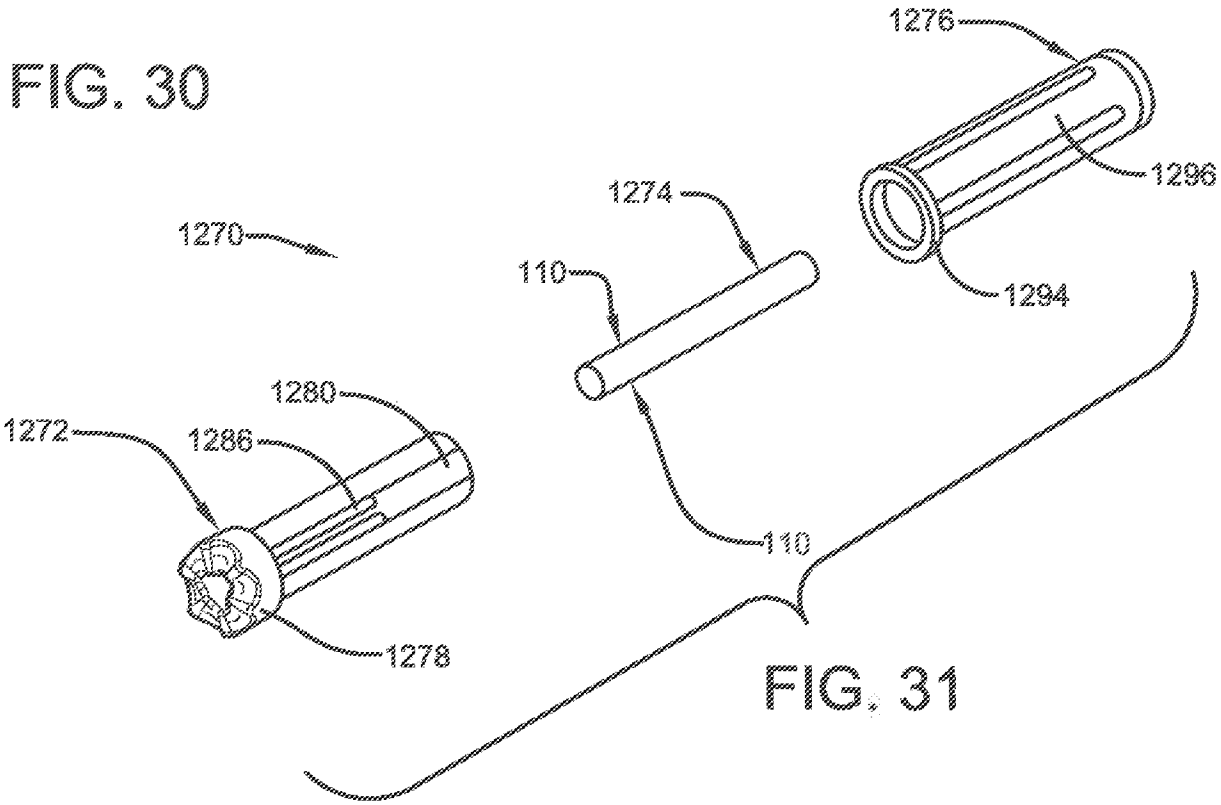

FIG. 31 is an exploded view of the lighted nock assembly shown in FIG. 30.

Figure 32:
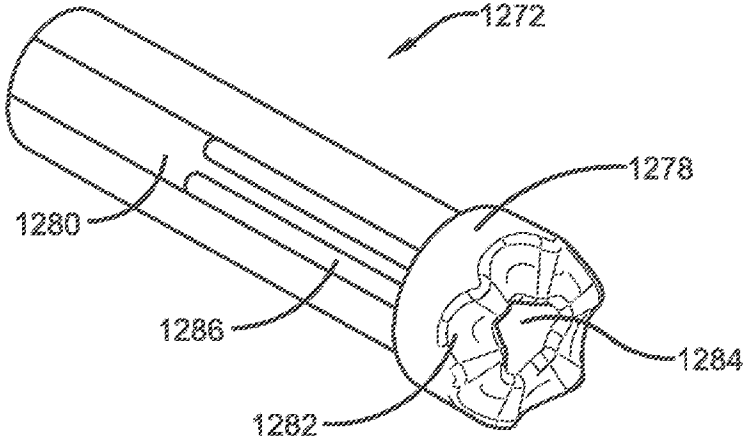

FIG. 32 is a perspective view of the nock shown in FIG. 31.

Figure 33:
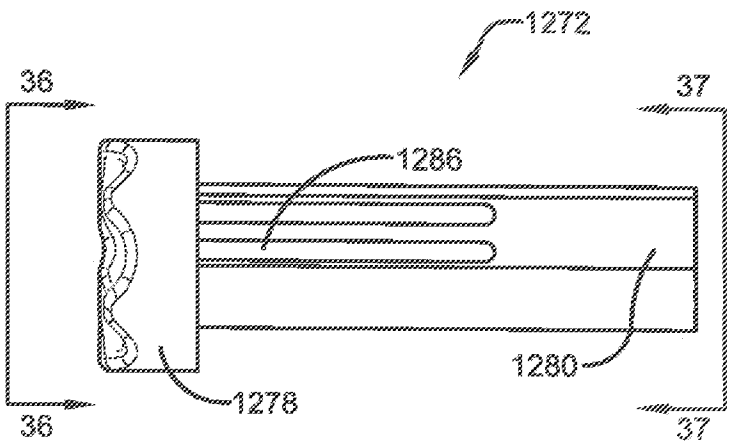

FIG. 33 is a side view of the nock shown in FIG. 31.

Figure 34:
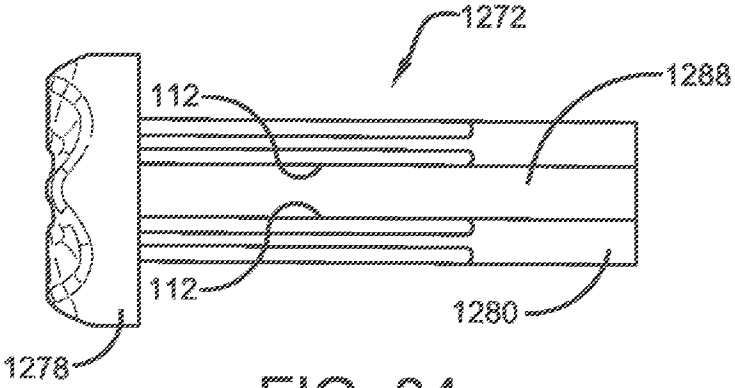

FIG. 34 is a side view of the nock shown in FIG. 31.

Figure 35:
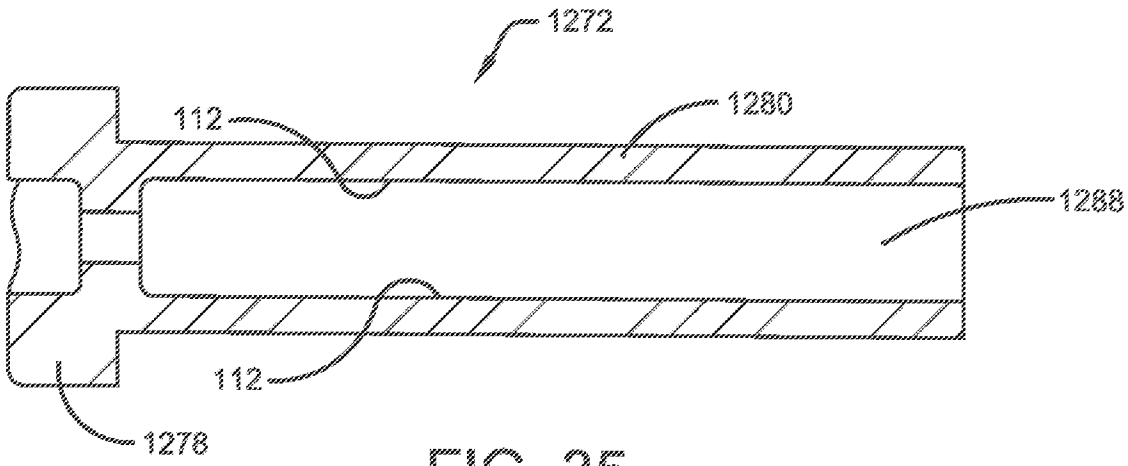
Figure 36:
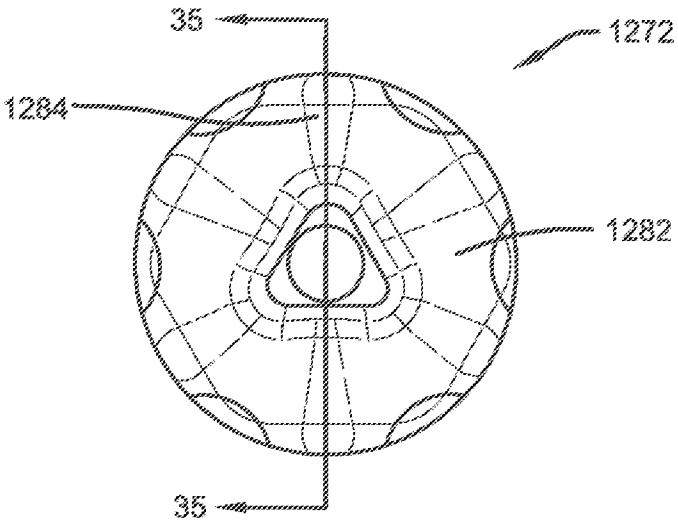

FIG. 35 is a sectional view of the nock taken along the line 35-35 in FIG. 36.

FIG. 36 is an end view of the nock taken along the line 36-36 in FIG. 33.

Figure 37:
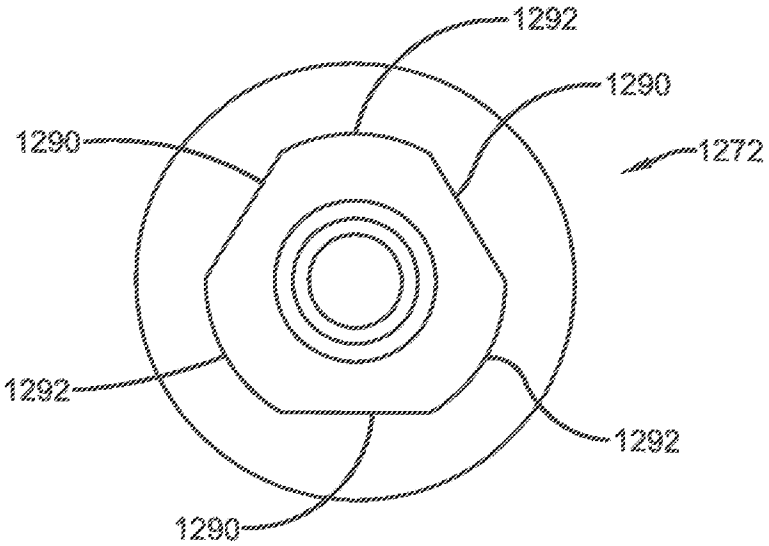

FIG. 37 is an end view of the nock taken along the line 37-37 in FIG. 33.

Figure 38:
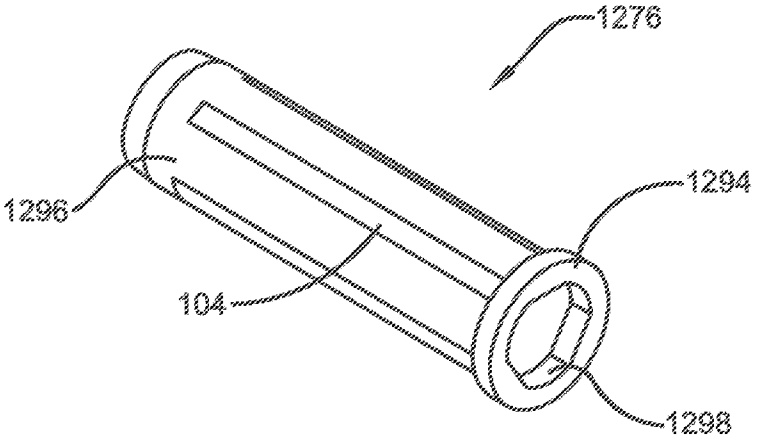

FIG. 38 is a perspective view of the insert shown in FIG. 31.

Figure 39:
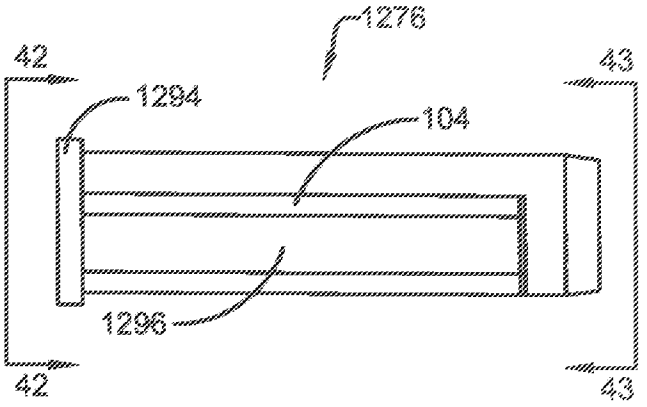

FIG. 39 is a side view of the insert shown in FIG. 31.

Figure 40:
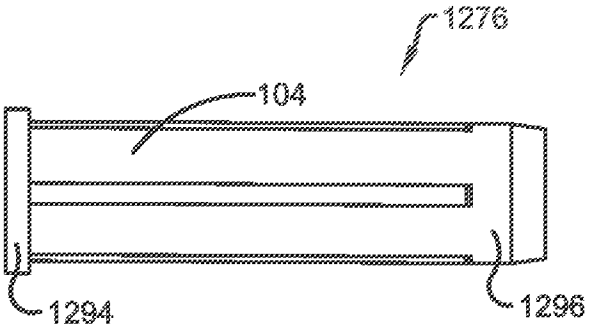

FIG. 40 is a top view of the insert shown in FIG. 31.

Figure 41:
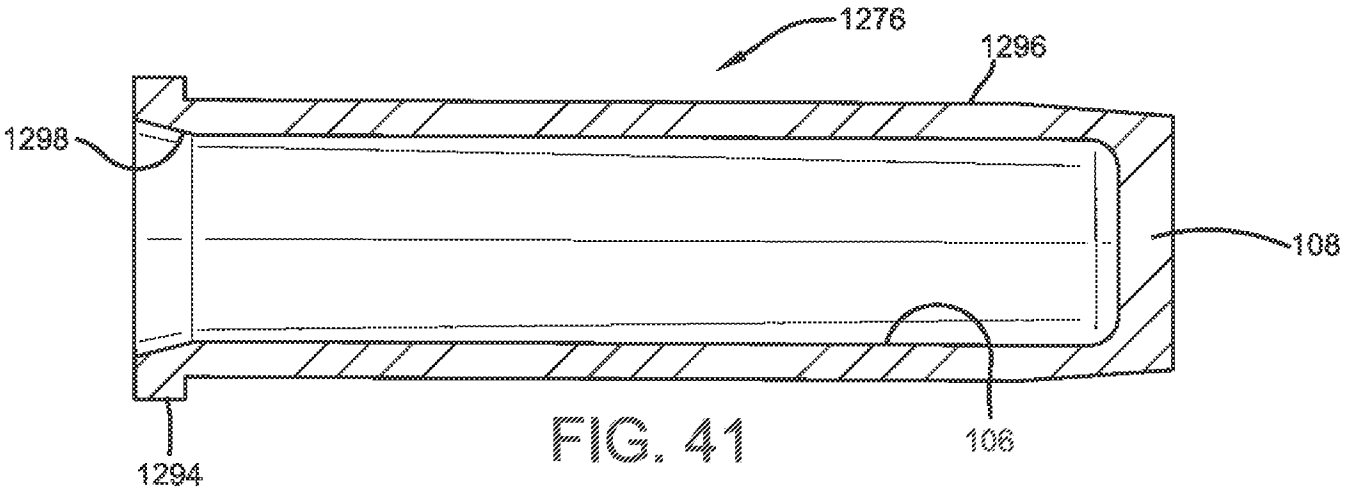

FIG. 41 is a sectional view of the insert taken along the line 41-41 in

FIG. 42.

Figure 42:
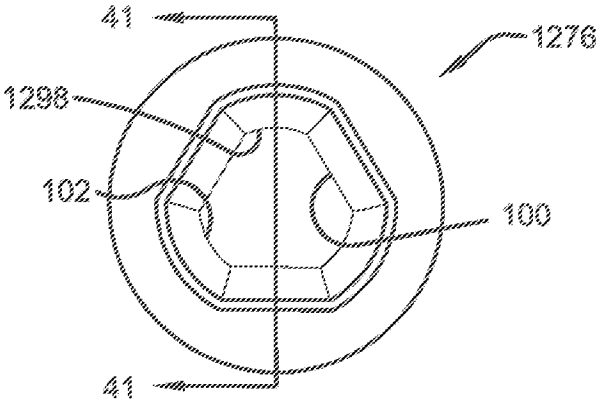

FIG. 42 is an end view of the insert taken along the line 42-42 of FIG. 39.

Figure 43:
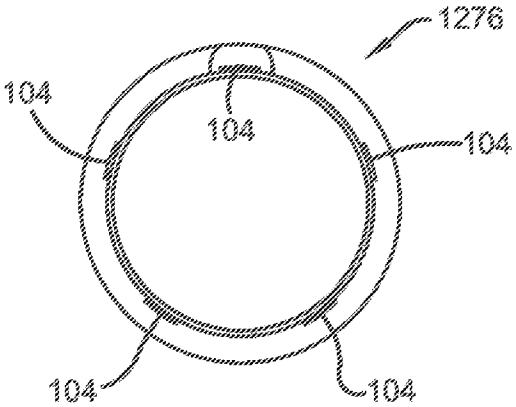

FIG. 43 is an end view of the insert taken along the line 43-43 of FIG. 39.

Figure 44:
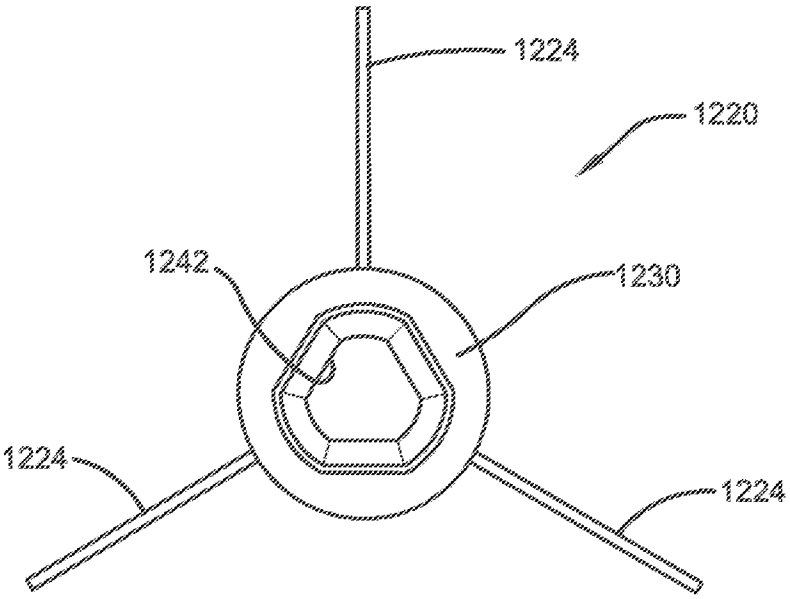

FIG. 44 is a back end view of an arrow with a nock attached to the arrow.

Figure 45:
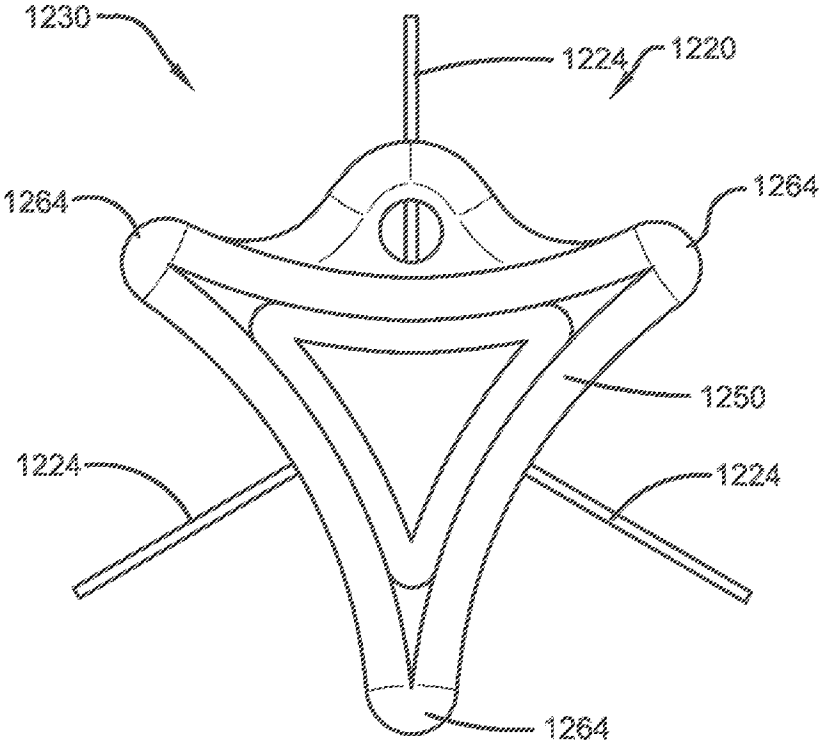

FIG. 45 is a back end view of the arrow shown in FIG. 44 but with the alignment tool attached to the nock.

Figure 46:
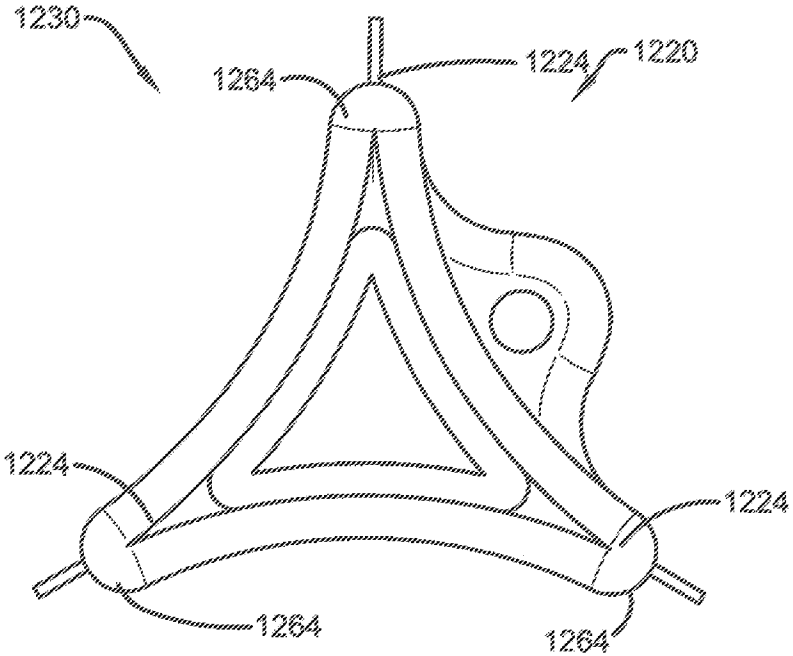

FIG. 46 is a back end view similar to that shown in FIG. 45 but with the alignment tool and nock rotated to align the nock with respect to the arrow's vanes.

Figure 47:
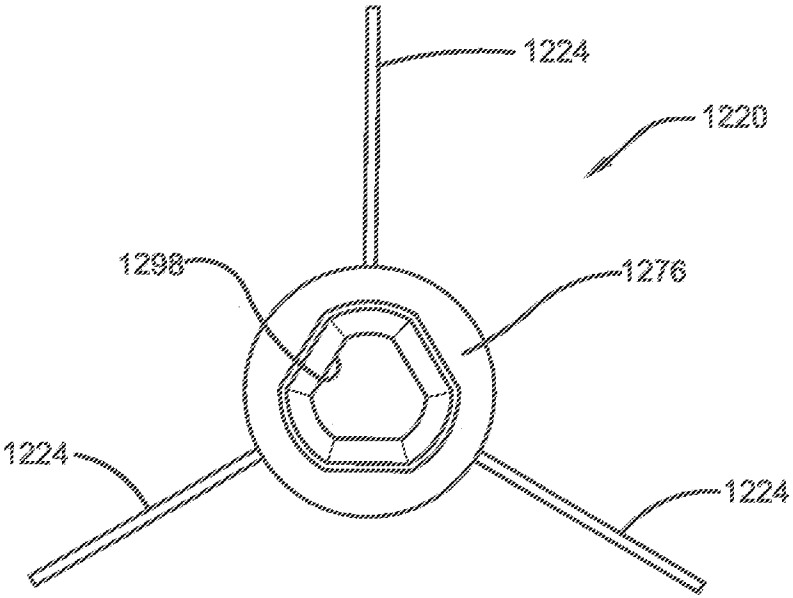

FIG. 47 is a back end view of an arrow with an insert attached to the arrow.

Figure 48:
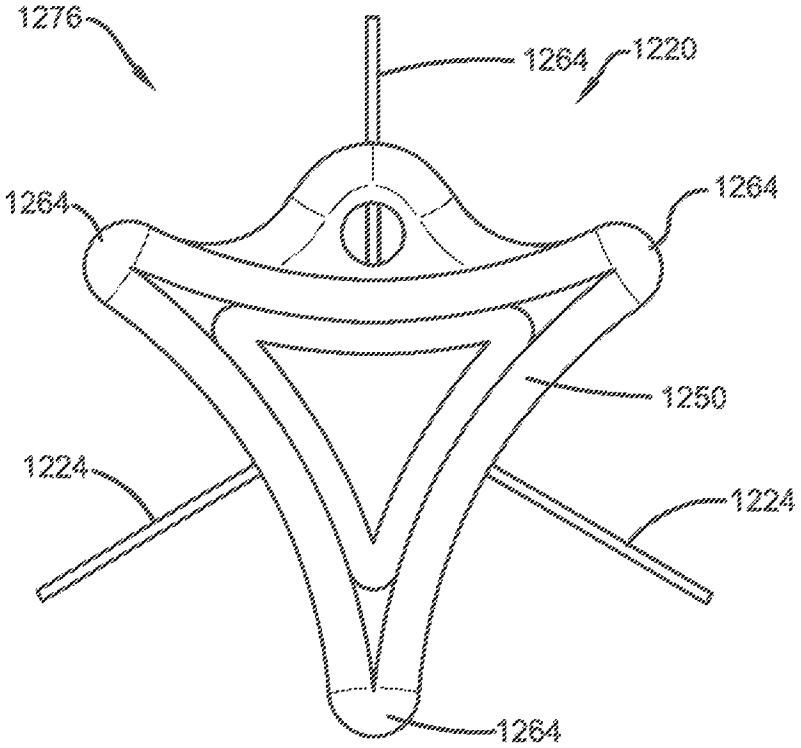

FIG. 48 is a back end view of the arrow shown in FIG. 47 but with the alignment tool attached to the insert.

Figure 49:
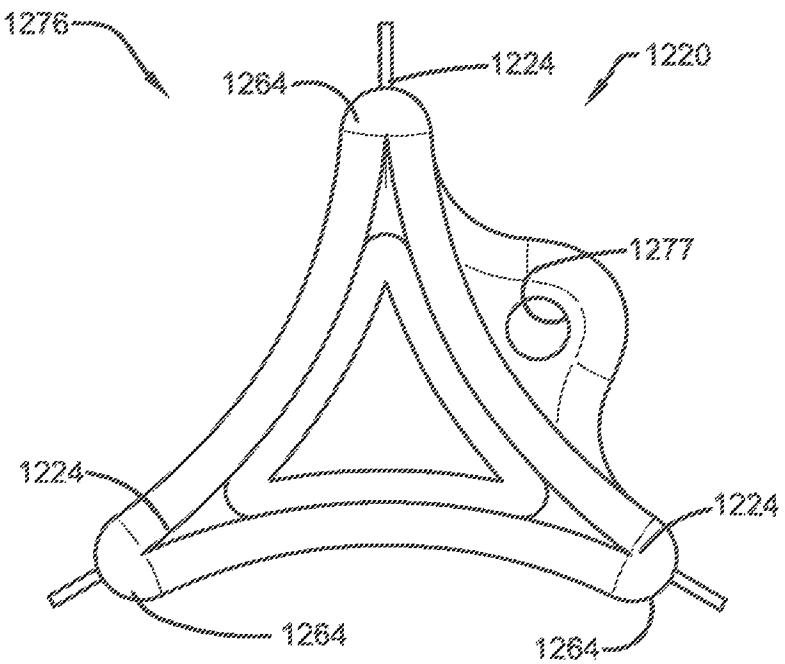

FIG. 49 is a back end view similar to that shown in FIG. 48 but with the alignment tool and insert rotated to align the insert with respect to the arrow's vanes.

IV. DETAILED DESCRIPTION

In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Referring now to the drawings wherein the showings are for purposes of illustrating embodiments of the invention only and not for purposes of limiting the same, and wherein like reference numerals are understood to refer to like components, FIGS. 4-8 illustrate one of more example implementations of a nock device 50 having an axial centerline CL and an attachment surface 54 that is configured to attach the nock to an associated arrow. FIG. 6A shows a back or rear view of a nock that includes a bowstring contact surface 59 that is configured to receive an associated bowstring to fire the associated arrow. The bowstring contact surface 59 may be positioned within a bowstring guide 61 that is defined by first and second walls 63, 65 separated by a floor 67 and by a distance D1. The bowstring guide 61 may include a first string guide impression 60*a* positioned on a first side of the nock's axial centerline CL and a second string guide impression 60*b* positioned on a second side of the axial centerline CL. The string guide impressions 60*a*, 60*b* may be symmetrically disposed on the top surface 64 of the top portion, as shown.

As illustrated in the example embodiments of FIGS. 5A, 5B, 5C, and 5D, the first string guide impression 60*a* is configured to receive a first part of a bowstring, and the second string guide impression 60*b* is configured to receive a second part of the bowstring. Further, the first string guide impression 60*a* is disposed at a first location on the top surface 64, and the second string guide impression 60*b* is disposed at a second location on the top surface 64. In this implementation, the first location and the second location are disposed at opposite ends of a first bisecting line 70*a* of the top surface 64.

Figure 5A:
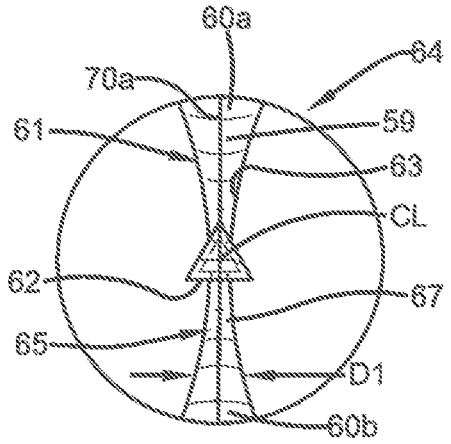
FIGS. 5A, 5B, 5C and 5D are component diagrams illustrating a rear view of example implementations of one or more systems described herein.
Figure 5B:
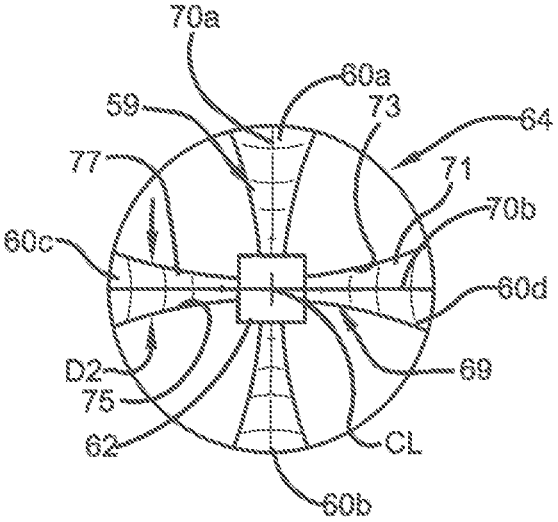

In one implementation, illustrated in FIG. 5B, two bowstring contact surfaces 59, 69 may be used. The bowstring contact surface 69 may also be configured to receive an associated bowstring to fire the associated arrow. The bowstring contact surface 69 may be positioned within a bowstring guide 71 that is defined by first and second walls 73, 75 separated by a floor 77 and by a distance D2. The bowstring guide 71 may include a first string guide impression 60*c* positioned on a first side of the nock's axial centerline CL and a second string guide impression 60*d* positioned on a second side of the axial centerline CL. The string guide impressions 60*c*, 60*d* may be symmetrically disposed on the top surface 64 of the top portion, as shown. In this implementation, the bowstring guide 71 is positioned along a bisecting line 70*b* that is angled with respect to the bisecting line 70*a* by about 90 degrees.

Figure 5C:
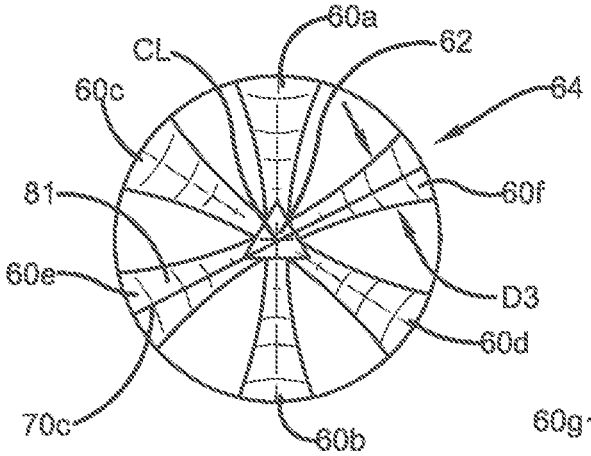

In another implementation, illustrated in FIG. 5C, three bowstring contact surfaces, each positioned within a bowstring guide may be used. The third bowstring guide 81 may be, as shown, defined by first and second walls separated by a floor and by a distance D3. The bowstring guide 81 may include a first string guide impression 60*e* positioned on a first side of the nock's axial centerline CL and a second string guide impression 60*f* positioned on a second side of the axial centerline CL. The string guide impressions 60*e*, 60*f* may be symmetrically disposed on the top surface 64 of the top portion, as shown. In this implementation, the bowstring guide 81 is positioned along a bisecting line 70*c* and each of the bisecting lines 70*a*, 70*b* and 70*c* are angled with respect to each neighboring line by about 60 degrees.

Figure 5D:
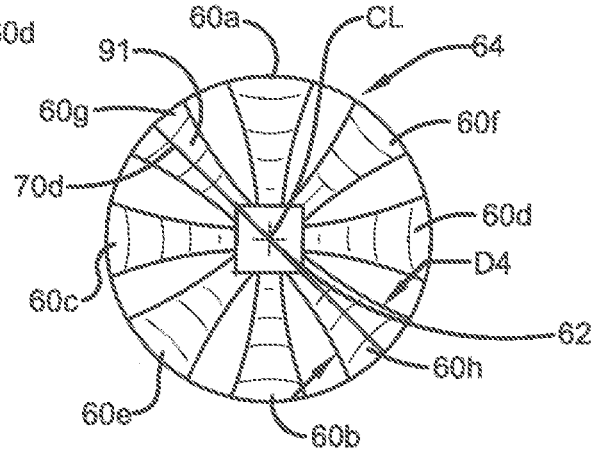

In yet another implementation, illustrated in FIG. 5D, four bowstring contact surfaces, each positioned within a bowstring guide may be used. The fourth bowstring guide 91 may also be defined by first and second walls separated by a floor and by a distance D4, as shown. The bowstring guide 91 may include a first string guide impression 60*g* positioned on a first side of the nock's axial centerline CL and a second string guide impression 60*h* positioned on a second side of the axial centerline CL. The string guide impressions 60*g*, 60*h* may be oriented as with the other string guide impressions explained above. In this implementation, the bowstring guide 91 is positioned along a bisecting line 70*d* and each of the bisecting lines 70*a*, 70*b*, 70*c* and 70*d* are angled with respect to each neighboring line by about 45 degrees. It will be understood that the systems, described herein, are not limited to the example implementations described above. It is anticipated that those skilled in the art may devise alternate arrangements for the string guide impressions.

For example, while implementations of up to four bowstring guides and four pairs of string guide impressions have been described above, utilizing symmetrical spacings of approximately one-hundred and eighty degrees, ninety degrees, sixty degrees, and forty-five degrees apart, other orientations are anticipated to be within the scope of the described systems. As one example, the top portion 52 may comprise five or more pairs of string guide impressions arranged in an orientation to accommodate a particular arrangement of fletching vanes and/or shooting arrangements (e.g., left-handed, right handed, crossbow, longbow, etc.).

Figure 6A:
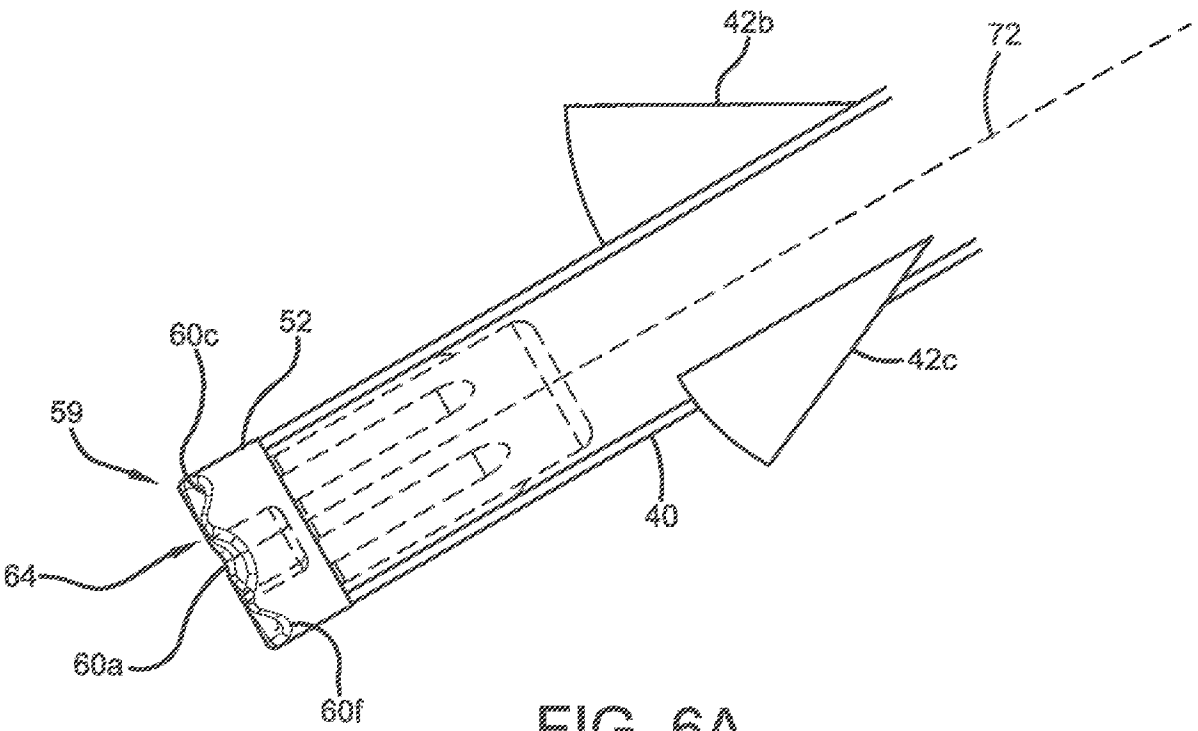
FIG. 6A is a component diagram illustrating a perspective view of an example implementation of a nock device for use in one or more systems described here.

In one implementation, the string guide impressions may be arranged in accordance with an arrangement of the fletching vanes of the arrow, for example, configured to accommodate the number and arrangement of vanes on the arrow (e.g., two, three, four, or more). That is, for example, when the nock device is attached to the arrow, a center line of a string guide impression 60 may be offset from a center line (measured along the length of the arrow) of one or the fletching vanes 42. As an illustrative example, FIG. 6A illustrates an example implementation of an arrangement of a portion of an arrow. In this implementation, an alignment of the fletching vane 42*c* can be offset from the center line 72 of the string guide impression 60*a* (e.g., by thirty degrees). Further, in this implementation, the alignment of the fletching vane 42*b* may be offset (e.g., by ninety degrees) from the center line 72 of the string guide impression 60*a* (e.g., and by thirty degrees from the center line or string guide impression 60*c*).

Figure 2A:
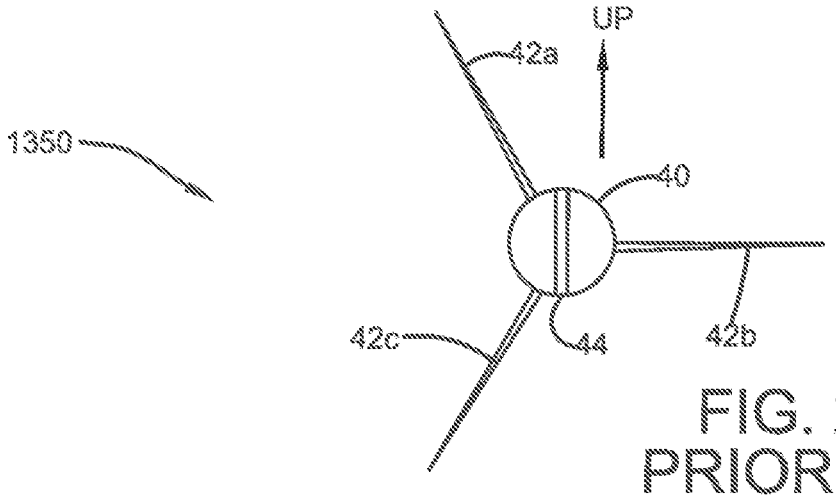
FIG. 2A PRIOR ART
FIGS. 2A, 2B and 2C are component diagrams illustrating a rear view of example implementations where one or more systems described herein may be implemented.
Figure 2B:
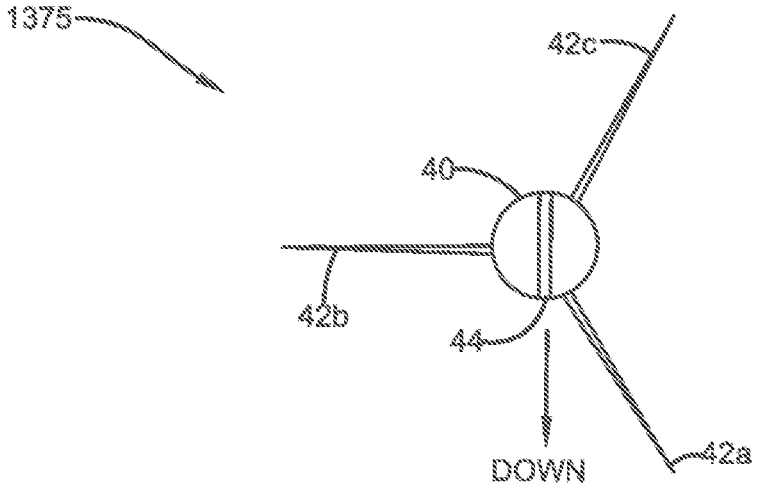
FIG. 2B PRIOR ART
Figure 2C:
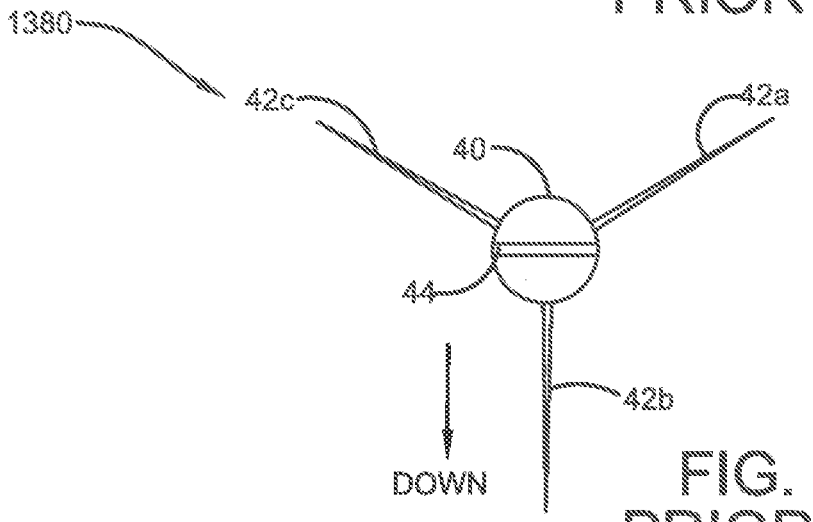
FIG. 2C PRIOR ART
Figure 6B:
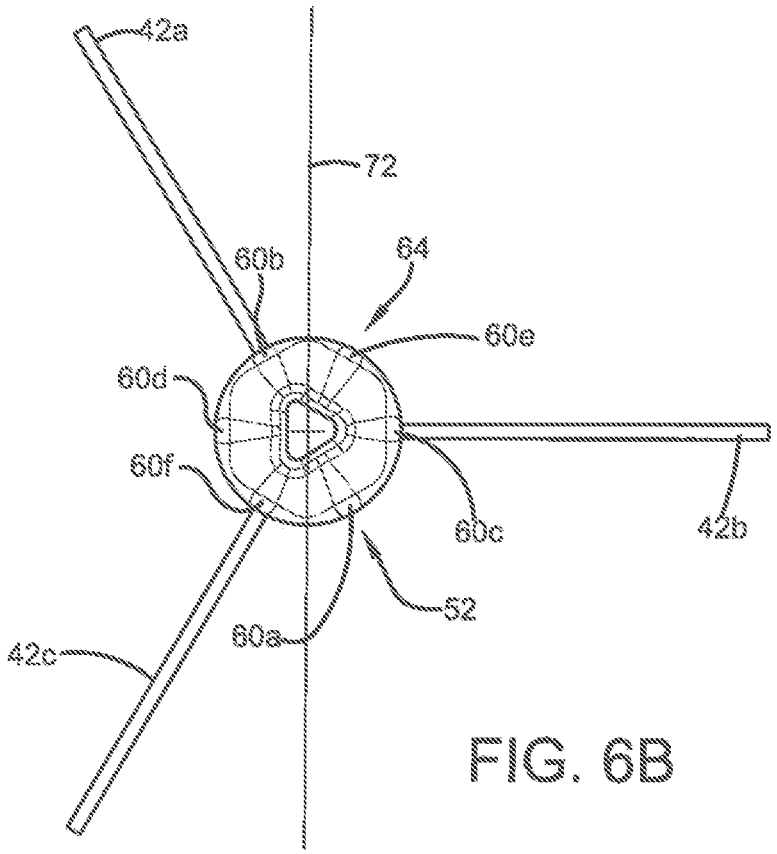
FIGS. 6B and 6C are component diagrams illustrating a rear view of an example implementation of a nock device for use in one or more systems described here.

As another illustrative example, in FIG. 6B, when using an arrow comprises merely three fletching vanes 42*a*, 42*b*, 42*c*, the nock device implemented can comprise three pairs of symmetrically aligned string guide impressions 60*a*-60*f* (e.g., FIG. 5C). In this example implementation, an arrangement of the impressions 60*a*-60*f* can be configured to mitigate interference of the fletching vanes 42*a*-42*c* with the structure of the bow, and/or accommodate the barrel of a crossbow. In order to mitigate interference of the vanes with the bow structure and/or accommodate a crossbow, the impressions 60 may be aligned when the nock device is inserted into the arrow shaft in an orientation (e.g., in FIGS. 2A and 2B) that allows the vane(s) to pass over the riser (e.g., for a bow), and/or to be inserted into a barrel (e.g., for a crossbow), appropriately.

Figure 6C:
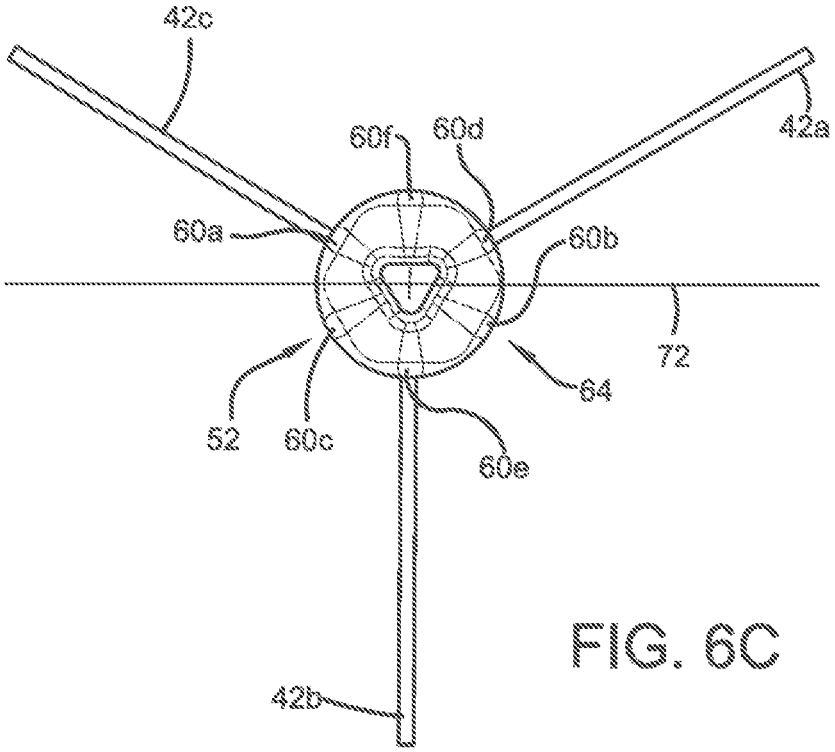
Figure 7A:
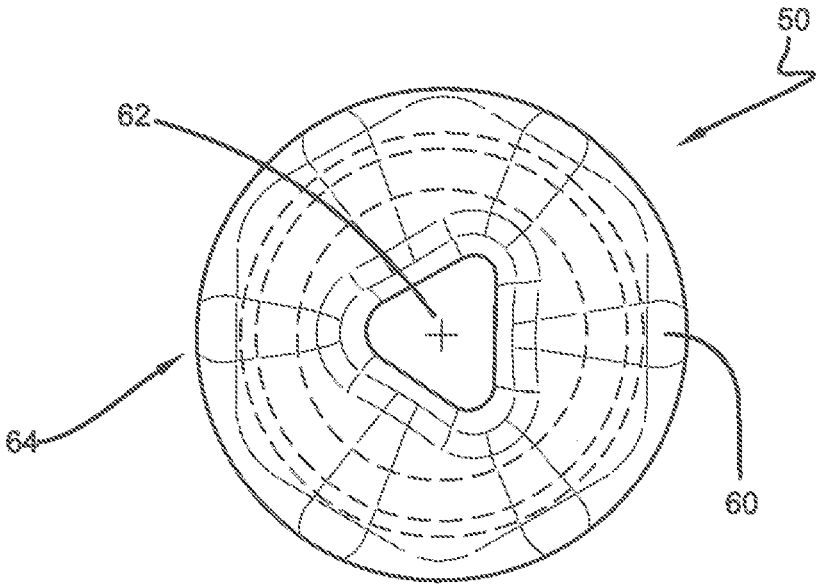
FIG. 7A is a component diagram illustrating a top solid view of an example implementation of a nock device.
Figure 7B:
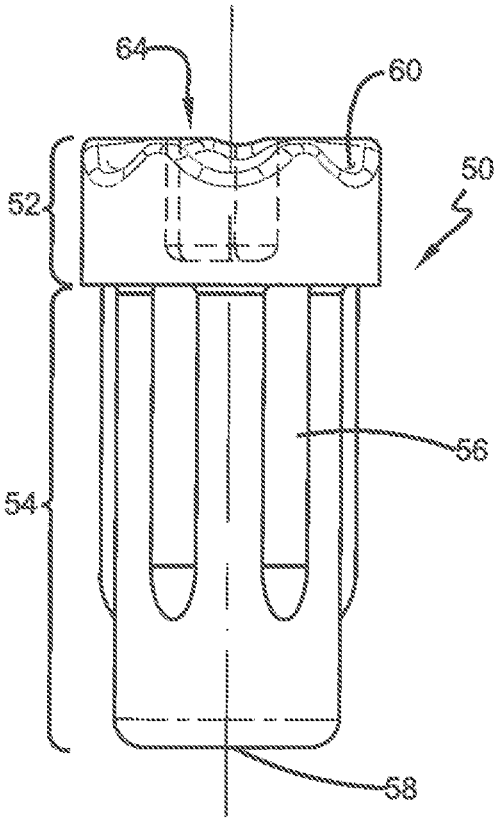
FIG. 7B is a component diagram illustrating a front solid view of an example implementation of a nock device.
Figure 7C:
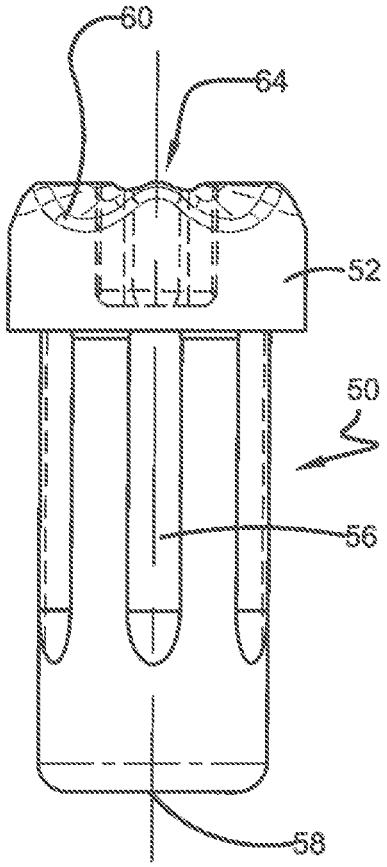
FIG. 7C is a component diagram illustrating a side solid view of an example implementation of a nock device.

In the example implementation of FIG. 6B, the center line 72 of the string guide impression 60*a* and 60*b* may comprise a centrally bisecting line on the top surface 64 of the top portion 52 of the nock device. Further, as one example, a user of the nock device may aligned the bowstring (e.g., of a bow and/or crossbow) along the center line 72 of the string guide impression 60*a* and 60*b*. In this example, a vertical bow, bowstring aligned in such a manner (e.g., for a left-handed archer) may allow the fletching vanes 42*a* and 42*c* to appropriately clear a vertical riser of the bow when the bowstring is released (e.g., thereby shooting the arrow). Further, as illustrated in FIG. 6C, a crossbow, bowstring aligned along the center line 72 in such a manner may allow the fletching vane 42*b* to be appropriately engaged (e.g., inserted down into) a barrel slot of the barrel of the crossbow; thereby allowing the arrow to be appropriately shot from the crossbow.

As another example, an arrow comprising three vanes (e.g., 42*a*, 42*b*, 42*c*), disposed one-hundred and twenty degrees apart from each other around the arrow shaft, may allow for three nocking positions (e.g., comprising six string guide impressions) on a bowstring of a bow and/or on the crossbow barrel. Further, for example, an arrow comprising two vanes, disposed one-hundred and eighty degrees apart, may utilize a nock device comprising four string guide impressions (e.g., FIG. 5B) at ninety degrees (e.g., allowing for two nocking positions, one for a bow the other for a crossbow). Additionally, as an example, an arrow comprising four vanes may utilize a nock device comprising eight string guide impressions (e.g., FIG. 5D), disposed at forty-five degrees apart (e.g., allowing for four nocking positions, two for a bow, two for a crossbow); and so on.

Returning to FIGS. 4-8, in one implementation, as illustrated in the example embodiments of FIGS. 4B, 4C, 7B and 7C, the attachment surface 54 can comprise a stem portion 54, which may comprise one or more outward protrusions 56 and/or a chamfered base 58. As an example, the stem portion 54 may be configured to be inserted into a rear opening of an arrow shaft. Further, for example, the chamfered base 58 of the stem portion 54 may be configured to facilitate insertion into the rear opening of an arrow shaft, where the rounded edges can mitigate snagging of the stem portion 54 on an edge of the rear opening of an arrow shaft. Additionally, as an example the outward protrusions 56 may facilitate securing the nock device 50 within the shaft of the arrow. That is, for example, the outward protrusions 56 can increase the diameter of the nock device 50 with respect to the diameter of the shaft, which may help form a pressure friction fit within the shaft of the arrow.

Figure 14:
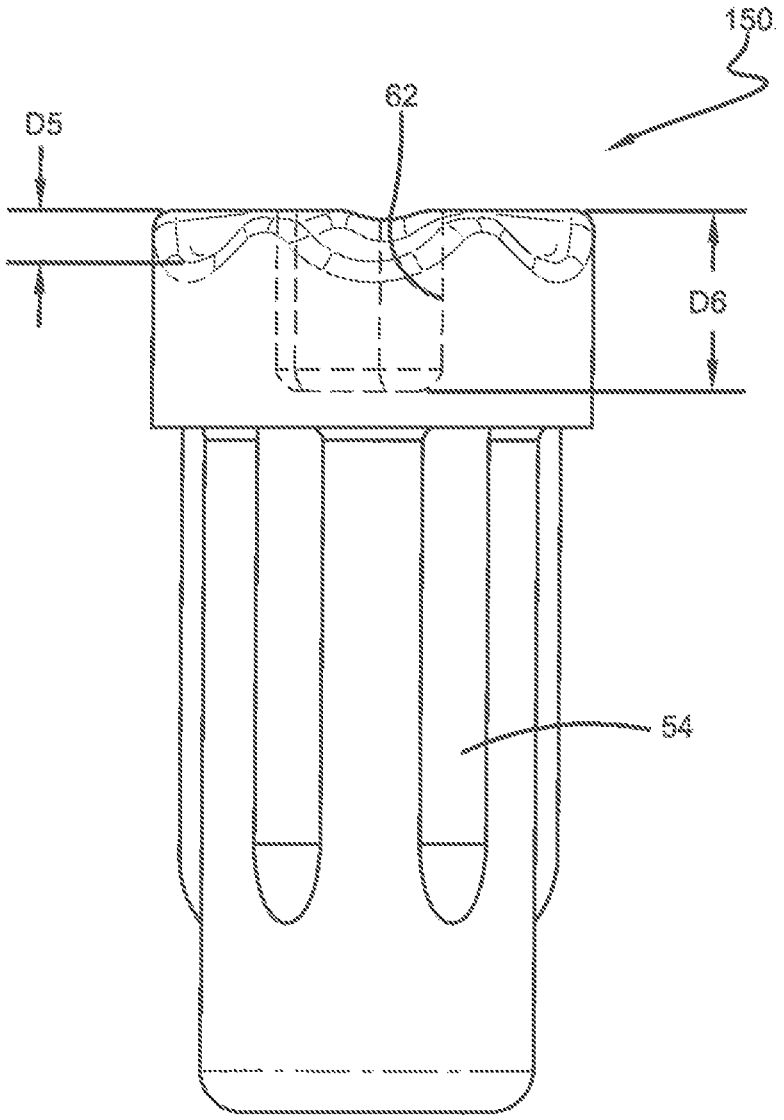
FIG. 14 is a component diagram illustrating a front solid view of an example implementation of a nock device.

In one implementation the top portion 52 may include a slot 62. The slot 62 may be disposed on or near the axial centerline of the top portion 52. In one implementation, shown, the slot 62 the slot extends into the nock farther than the floor of the bowstring guide. FIG. 14, for example, shows the floor of the nock 50 extending into the nock a distance D5 and the slot 62 extending into the nock a distance D6 with D6 being greater than D5. In one specific implementation, D5 is approximately 0.04 inches and D6 is approximately 0.2 inches. The slot, in one implementation, may be used as an attachment slot as described further below. In one implementation, the slot 62 may be formed into a triangular shape. In other implementations, the slot 62 may be formed to any appropriate shape for aligning an attachment, such as a square and/or other polygon.

Figure 8:
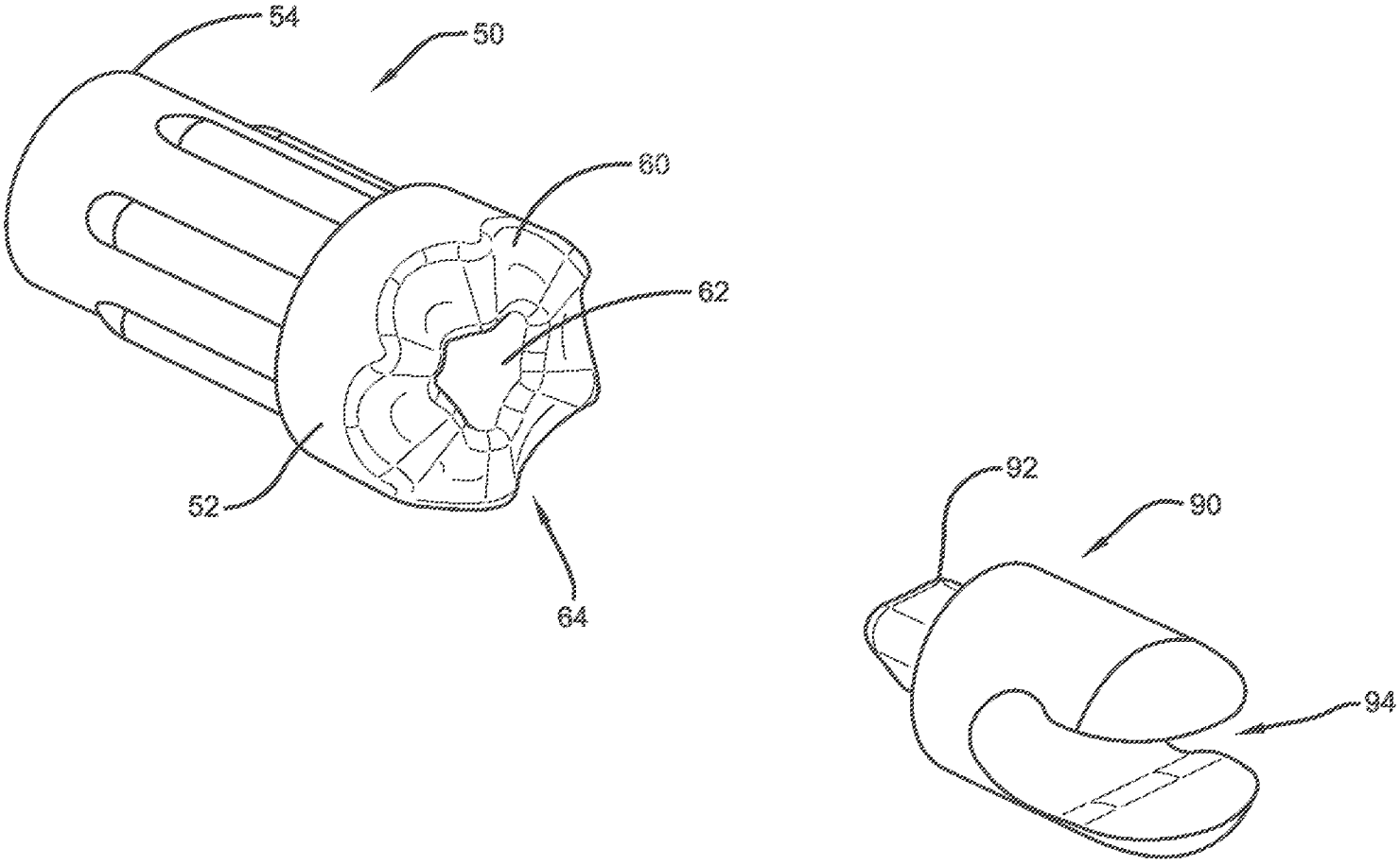
FIG. 8 is a component diagram illustrating a perspective view of an example implementation of one or more portions of the systems described herein.
Figure 9A:
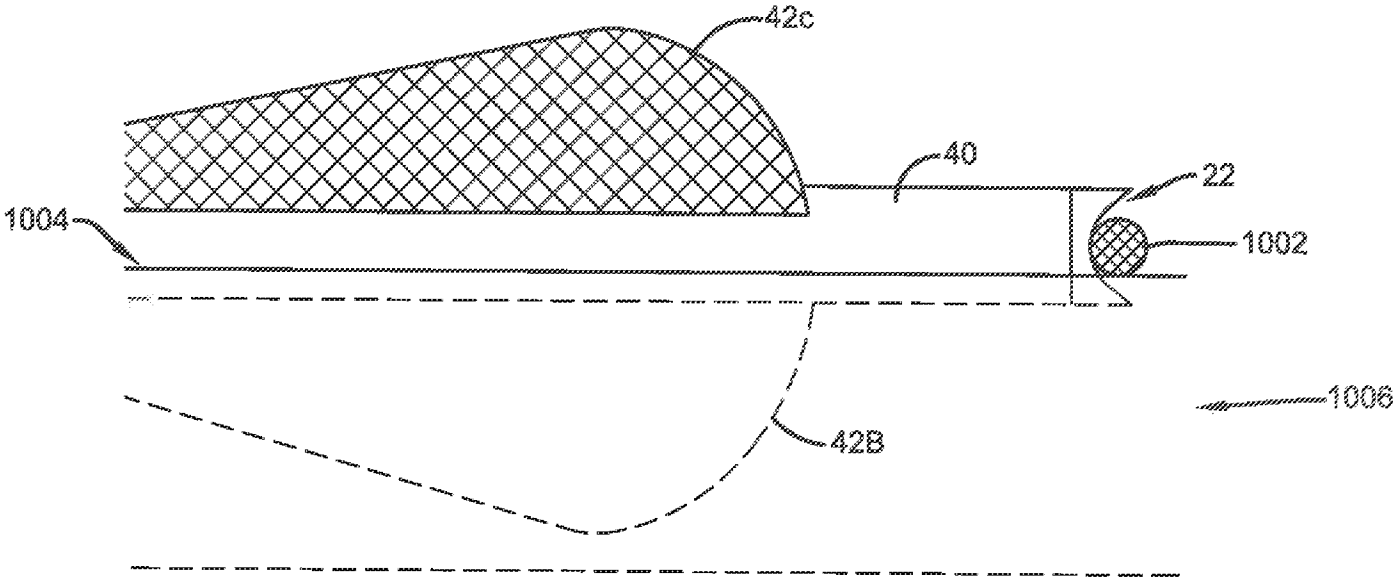
FIGS. 9A and 9B are component diagrams illustrating example implementations where a nock may be utilized.
Figure 9B:
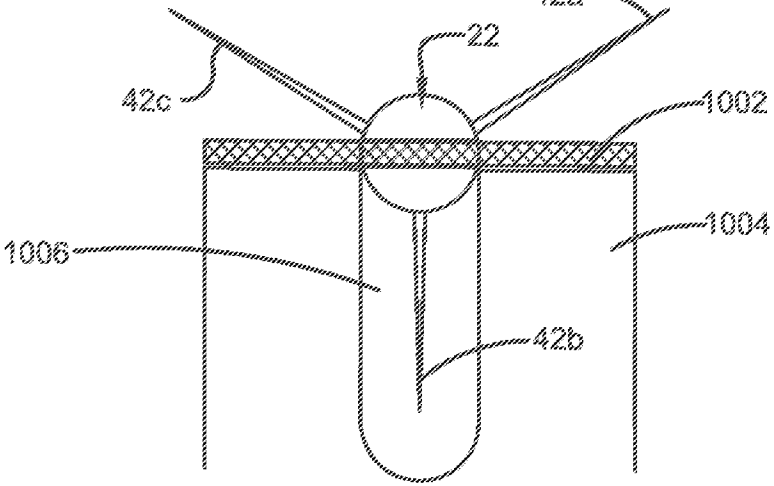

FIG. 8 is a component diagram illustrating an example implementation of the nock device. In one implementation, the nock device 50 can comprise a nock guide or tool 90. The nock guide 90 may be configured to be selectively removable from the nock device 50, such as from the attachment slot 62. The nock guide 90 may be further configured to facilitate appropriate alignment of the nock device 50, for example, when assembled to an arrow. In one implementation, the nock guide 90 can comprise a male portion 92 that is configured to selectively mate with the attachment slot 62. As one example, a shape of the male portion 92 may comprise a complimentary shape of an attachment slot 62 to which it is intended to be mated (e.g., both the male portion and slot are triangular, or square, etc.).

In one implementation, the nock guide 90 can be attached to the nock device 50, and the bowstring of the bow (e.g., longbow, crossbow, etc.) may be inserted into a nock guide slot 94 of the nock guide 90. As one example, an arrow shaft may be attached to the stem portion 54 of the nock device 50 while the user aligns the fletching vanes in accordance with the desired use (e.g., right-handed, left-handed, longbow, crossbow, etc.) In this way, for example, the arrow, the nock guide 90, and nock device 50 can be in appropriate alignment with the fletching vanes of the arrow, such as for use with crossbows in aligning the vanes within the slotted portion of the barrel.

As an illustrative example, in an operation of a bow, the bowstring is cocked and the arrow, with the nock against the bowstring, is drawn back with the bowstring. In accordance with one implementation of the nock device 50 comprising the three pairs of string guide impressions, the arrow can be aligned any one of three arrangements in accordance with the vanes of the arrow, the handedness of the shooter, and/or the arrangement of the bow riser/handle. As another example, in operation of a crossbow, the bowstring is cocked into a ready-to-shoot position by the user. Subsequently, the arrow can be loaded on the barrel, with at least one of the vanes inserted into a slotted portion of the barrel, with the nock device 50 pressed against the bowstring. In this example, the arrow may be aligned in any one of three positions, in accordance with the vanes of the arrow and the slotted portion of the barrel.

Now with reference to FIGS. 9-12, and continued reference to FIGS. 4-8, in one aspect, when a traditional nock, such as a half-moon nock, is misaligned with the bowstring 1002, for example, such that a centerline of the groove portion 22 of the nock is not aligned with (e.g., parallel to) the bowstring 1002, the arrow 40 may not shoot from the bow (e.g., crossbow) in a desired manner. That is, for example, a user of a bow (e.g., crossbow, vertical bow) may occasionally misalign a traditional nock with the bowstring 1002. A misalignment of this type can result in undesirable flight characteristics for the arrow 40 when the bowstring 1002 is released, for example, causing the arrow 40 to miss an intended target.

As one example, the groove portion 22 of a half-moon nock (e.g., and other traditional nocks) is configured to align parallel to, and engage with, the bowstring 1002. Due to this alignment, as described above, merely one configuration of the fletching vanes 42 of an arrow 40 may be utilized. For example, when a crossbow is used, a first fletching vane 42*b* is disposed in the barrel slot 1006 of the barrel 1004 of the crossbow, such that the groove portion 22 of the nock is appropriately aligned with the bowstring 1002. Further, two second vanes 42*a*, 42*c* are disposed above (e.g., and not in contact with) the barrel 1004. In this way, for example, when the bowstring is released from a shooting position (e.g., the crossbow is shot), the arrow may travel properly down the barrel, and may further travel a desired flight path (e.g., to the intended target).

Figures 10A, 10B, 10C:
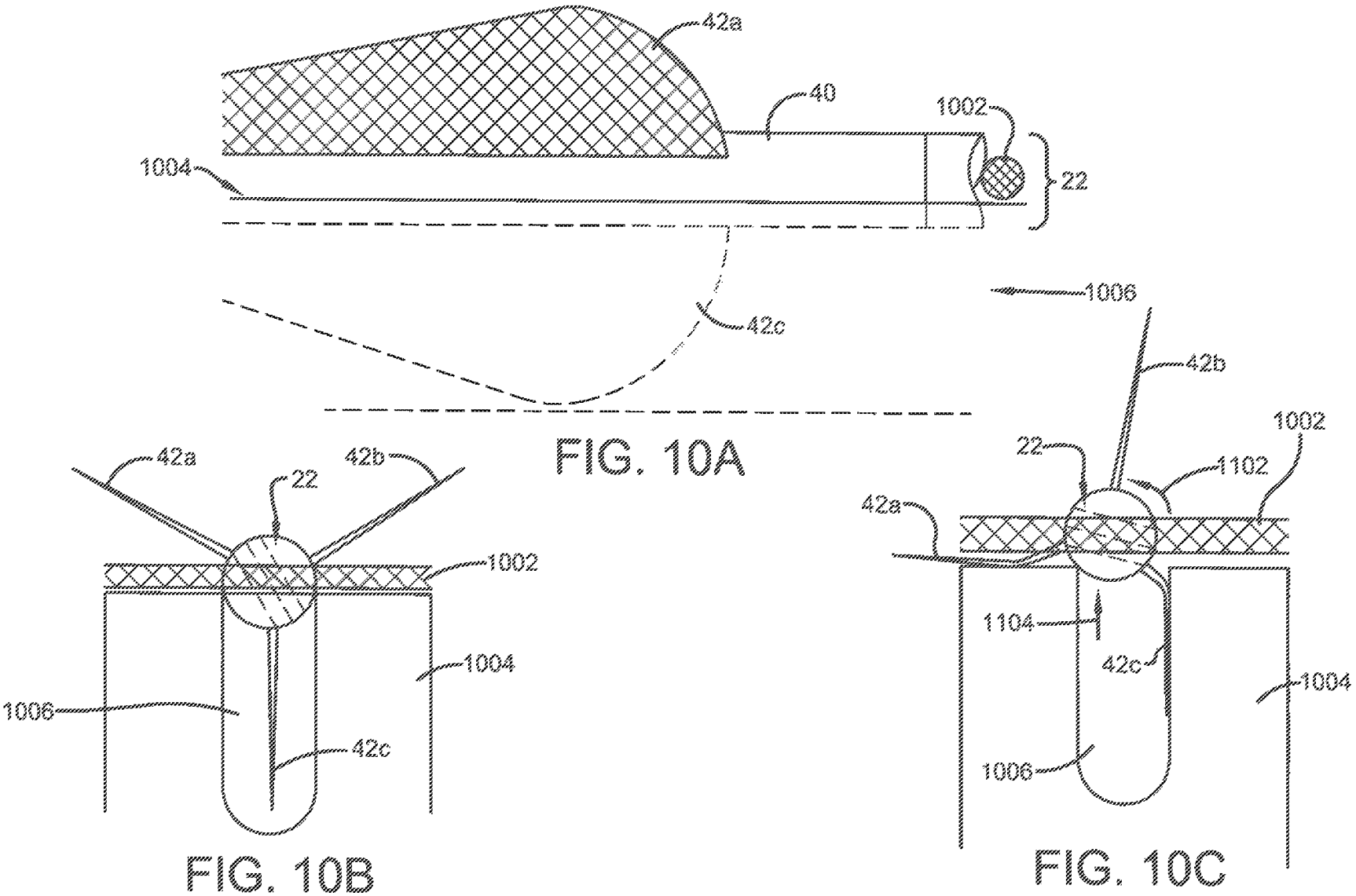
FIGS. 10A, 10B and 10C are component diagrams illustrating example implementations where a nock may be utilized.
Figure 11A:
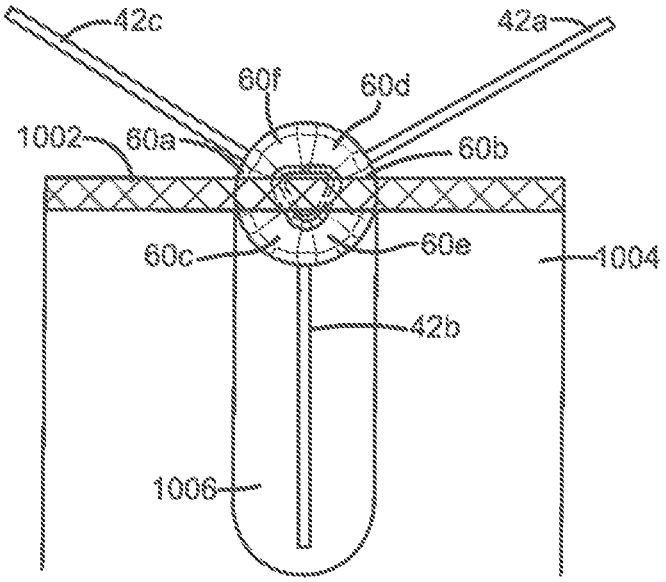
FIGS. 11A and 11B are component diagrams illustrating example implementations where one or more systems described herein may be implemented.
Figure 11B:
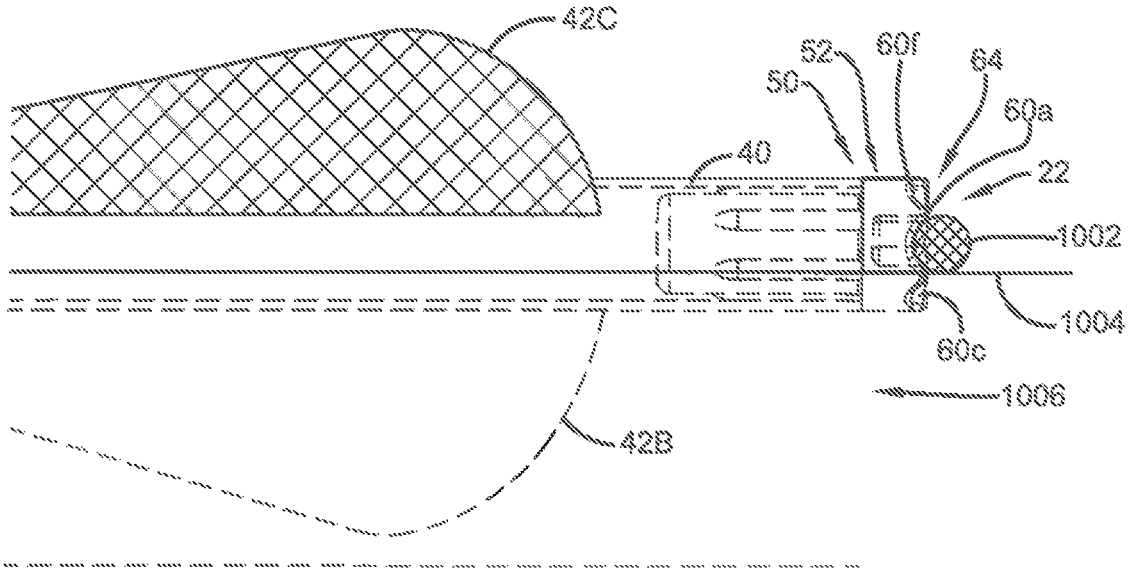
Figure 12B:
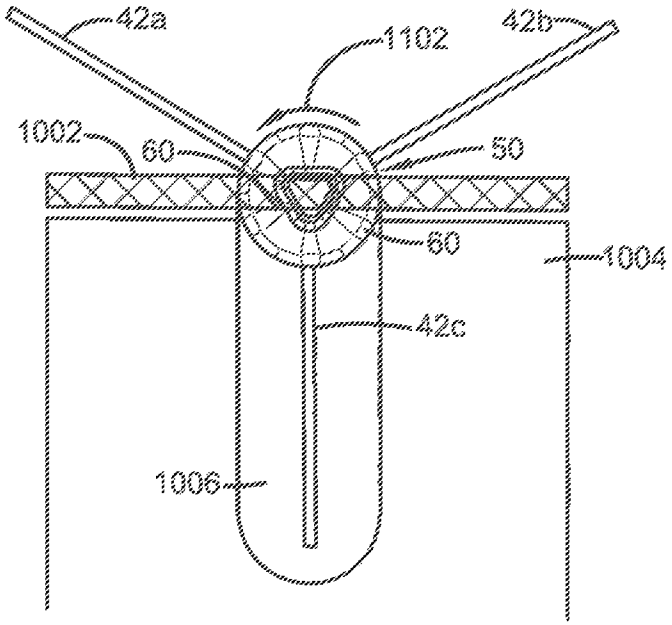
FIGS. 12A and 12B are component diagrams illustrating example implementations where one or more systems described herein may be implemented.
Figure 12A:
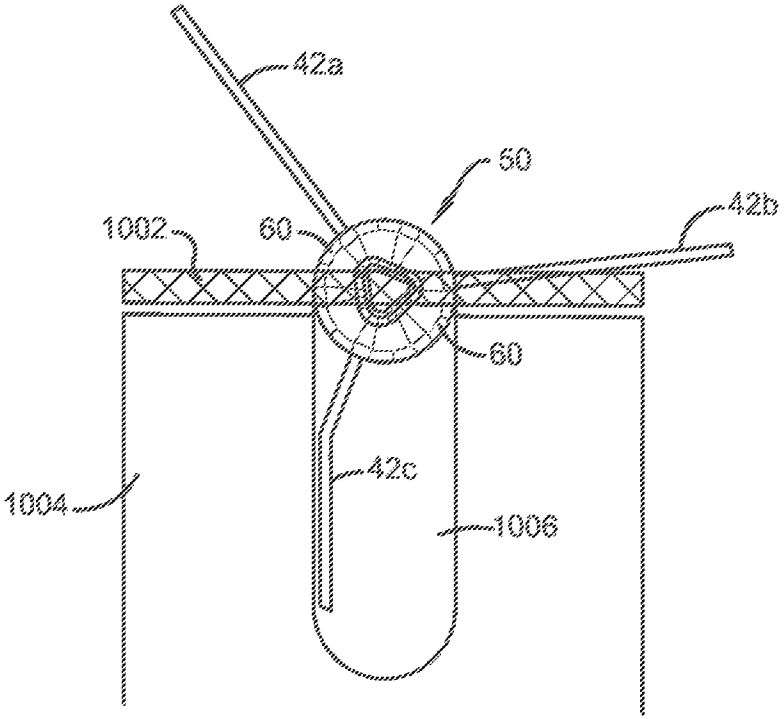

However, an arrow 40 shot with a misaligned nock may rise up 1104 from the barrel 1004, and/or rotate 1102 out of the barrel slot 1006 of a crossbow, causing an inaccurate shot. As one example, rotating a groove portion 22 of a half-moon nock out of alignment with the bowstring 1002, as illustrated in FIGS. 10A-C, can cause the arrow to rise 1104 and rotate 1102 out of the barrel slot 1006 when shot from the crossbow. In this example, raising 1104 and rotating 1102 the arrow 40 out of the barrel slot 1006 may cause the arrow 40 to miss the intended target, due to undesired alignment of the arrow's fletchings 42 during a flight path of the shot.

In one implementation, the user of the crossbow may misalign the groove portion 22 of the traditional nock with the bowstring 1002, for example, by inadvertently placing the incorrect fletching vane 42*c* in the barrel slot 1006. In this implementation, for example, when the bowstring 1002 is released (e.g., shot) the shape of the groove portion 22 of the half-moon nock may cause the arrow 40 to rotate 1102 (e.g., counter-clockwise in this example) as the groove portion 22 is forced to align with the bowstring 1002 during the shot (e.g., due to a great force applied by the bowstring to nock during a shot). Further, in this example, the rotation 1102 of the arrow 40 can force the fletching vane 42*c* against a wall of the barrel slot 1006, thereby pushing the arrow 40 up 1104 and out of the barrel slot 1006 during the shot. Additionally, the rotation 1102 can force the fletching vane 42*a* against the barrel 1004, further providing for the arrow 40 to rise 1104 out of the barrel slot 1006 (e.g., due to the configuration of the vanes 42).

In one implementation of this aspect, as illustrated in FIGS. 11A-B and 12A-B, when an arrow 40 comprising the alternate nock design 50 is misaligned on the bowstring 1002, the design of the alternate nock 50 can cause the arrow 40 to rotate into appropriate alignment upon release of the bowstring 1002. That is, for example, instead of causing the arrow to rise and rotate out of the barrel slot 1006 of a crossbow, the bowstring 1002 engaging with the alternate nock 50 can cause the arrow 40 to rotate 1102 into appropriate alignment (e.g., in the barrel slot 1006) prior to release from the bow, and not deviate from a desired path (e.g., rise up), thereby providing a more accurate shot.

In this implementation, the disposition of the string guide impressions 60 on the top surface 64 of the top portion 52 of the nock 50 may provide for multiple alignment positions for the arrow 40, with respect to the fletching vanes 40 and the bow. That is, for example, when using a crossbow, a first fletching vane 42*b* may be disposed in the barrel slot 1006, where respective second fletching vanes 42*a*, 42*b*, are disposed above, and not in contact with, the barrel. In this example, the first string impression 60*a* and the second string impression 60*b* may be engaged with the bowstring 1002 in a desired alignment (e.g., parallel). Further, if the arrow 40 is rotated such that the fletching vane 42*a* is disposed in the barrel slot 1006, string guide impression 60*e* and 60*f* may provide an appropriate alignment with the bowstring 1002. Additionally, if the arrow 40 is again rotated such that the fletching vane 42*c* is disposed in the barrel slot 1006, string guide impression 60*c* and 60*d* may provide an appropriate alignment with the bowstring 1002. That is, for example, regardless of which fletching vane 60 is disposed in the barrel slot 1006, an appropriate alignment of the bowstring 1002 to a string guide impression may be maintained.

In one implementation, in this aspect, use of the nock device 50 (e.g., described in FIGS. 4-8, 11, and 12) may mitigate undesired flight path characteristics for an arrow 40 that is misaligned with respect to the bowstring 1002. As one example, as in FIG. 12A, the nock device 50 may not be fully engaged with the bowstring, such that the bowstring 1002 is not in full contact with the respective string guide impressions (e.g., the nock is, at least, partially offset from the bowstring). In this example, the string guide impressions may not be aligned properly with the bowstring 1002 (e.g., the bowstring may not be aligned with the first bisecting line). In this implementation, for example, when the bowstring 1002 is released (e.g., the arrow is shot) the nock device 50 may cause the arrow 40 to rotate 1102 into proper alignment, prior to release from the bow, upon the bowstring 1002 engaging the nock device 50 (e.g., as in FIG. 12B).

As one example, the string guide impressions 60 may comprise a concave impression with gradually sloping sides (e.g., as illustrated in FIGS. 4B, 4C, 6A, 7B, 7C, and 8). In this implementation, for example, the concavity design of the impression 60 may allow the bowstring to slide down a gradually sloping side to the base of the impression 60, upon release of the bowstring 1002, when the bowstring 1002 is not appropriately aligned with the bisecting line 70 of the impression 60 (e.g., with the base of the impression 60). In this way, for example, an arrow 40 engaged with the alternate nock device 50 may rotate 1102 into proper alignment with the bowstring 1002, as the bowstring 1002 slides into the base of the impression 60 (e.g., the nock 50 slides up the bowstring 1002), upon release of the bowstring 1002.

A method may be devised wherein an alternate nock device may be used, for example, to nock an arrow for subsequent shooting (e.g., from a bow and/or crossbow). Typical nocks merely provide for a single alignment of a bowstring, for example, where the arrow may be oriented in an up or down position, according a nock's groove (e.g., bowstring receiver). Some flat nocks may allow for multiple alignments of the bowstring against the nock, but they may not provide for a centering (e.g., comprising a central bisection) of the bowstring on the flat portion of the nock. Using an alternate nock design (e.g., 50 in FIGS. 4-8), the user may be able to align the arrow on the bowstring in multiple alignments, and/or may be able to appropriately center the bowstring on the back (e.g., top surface) of the nock.

Figure 13:
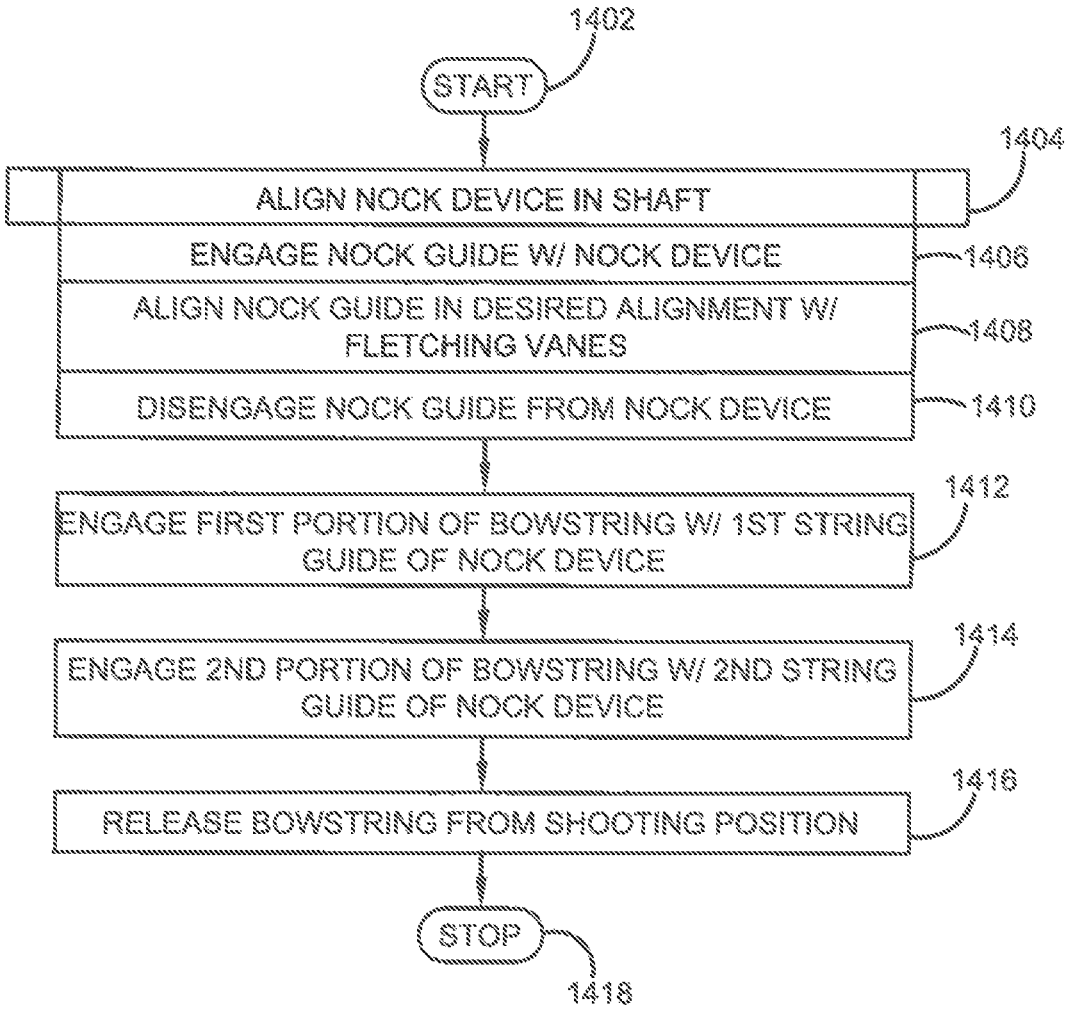
FIG. 13 is a flow diagram illustrating an implementation of an exemplary method for using a nock device.

FIG. 13 is a flow diagram illustrating an exemplary method 1000 for using a nock device. The exemplary method 1400 begins at 1402. At 1404 a process of aligning the nock device on/in a shaft of an arrow begins. That is, for example, when a nock is engaged with the shaft of the arrow, it is typically aligned in accordance with fletchings attached to the shaft. At 1406, a nock guide can be engaged with the nock device. As described above, the nock device may comprise an attachment slot on its top (e.g., back) surface of its top portion. In one implementation, the attachment slot can protrude, at least partially, into top portion of the nock device, for example, into which a user may selectively engage a male portion of the nock guide.

At 1408, the nock guide can be aligned in a desired alignment with the arrow's fletching vanes. As one example, the nock guide can be used to guide engagement of the nock device with the arrow shaft to a desired orientation, for example, with respect to one or more arrow fletching vanes disposed on said arrow shaft. As described above, the nock guide may comprise a groove, for example, that may engage a bowstring. In this example, the groove of the nock guide (e.g., 94 of FIG. 8) may be appropriately aligned with the bowstring, and the fletchings may be appropriately aligned (e.g., appropriate for a bow or crossbow) for shooting. In one embodiment, when aligned to the desired orientation, the nock device may be fully engaged (e.g., friction/pressure fit, and/or glued) in the desired orientation.

At 1410, the nock guide may be disengaged from the nock device. For example, the male portion of the nock guide may be pulled from the attachment slot on top of the top surface of the nock device. At 1412, a first portion of the bowstring can be engaged with a first string guide impression on the nock device; and a second portion of the bowstring can be engaged with a second string guide impression on the nock device, at 1414. In one implementation, a bowstring guide on the nock device may comprise a pair of impressions (e.g., the first and second), respectively disposed at opposite ends of a generally, centrally bisecting line across the top surface of the nock device. In this implementation, the user may engage (e.g., nock) the arrow to the bowstring by engaging the bowstring with both of the impressions in the pair, at two different locations (e.g., either end of the bisecting line). In this way, for example, the bowstring can be centrally aligned on the top surface of the nock, and, therefore, centrally aligned on the back of the arrow.

In one implementation, the nock device may comprise a third and a fourth string guide impression (e.g., a pair of impressions) that are respectively located at opposite ends of a second generally, centrally bisecting line of the top surface. In one implementation, the nock device may comprise a fifth and a sixth string guide impression that are respectively located at opposite ends of a third generally, centrally bisecting line of the top surface. In one implementation, the respective bisecting lines (e.g., and therefore the respective impressions) can be oriented on the top surface in a generally symmetrical layout, for example, such that an intersection of any two lines comprises a similar angle (e.g., ninety degrees, sixty degrees, forty-five degrees, thirty-six degrees, and/or thirty degrees), such as illustrated in FIGS. 5A-6D. In this way, for example, the user may engage (e.g., nock) the arrow to the bowstring using any one of the string guide impression pairs, based on the user's desired orientation of the arrow's fletchings.

At 1416 of the exemplary method 1400, the bowstring, engaged with the nock device, may be released from a shooting position. As one example, a bowstring of a bow (e.g., recurve, long, compound, etc.) may be released from a shooting position (e.g., where the bow is cocked, drawn, etc.) by the user when the user uncocks (e.g., straightens) their fingers wrapped around the bowstring, or may be released when the user opens or releases a bowstring release device engaged with the bowstring. As another example, a bowstring of a crossbow may be released when the user activates (e.g., pulls, releases, etc.) a trigger mechanism engaged with the bowstring. Typically, when the bowstring is released, the engagement of the nock to the bowstring causes the arrow to be shot from the bow (e.g., bow, crossbow).

With reference now to FIGS. 5A-5D, in one implementation shown, the distance D1, D2, D3 and/or D4, between the first and second walls of the bowstring guide is greater at a relative radially outer portion than at a relative radially inner portion. This design assists in centers the bowstring within the bowstring guide. In one implementation, the distances D1, D2, D3, and/or D4 gradually change (narrow) moving from the relative radially outer portion toward the relative radially inner portion. For the implementation shown, distances D1, D2, D3 and D4 are equal to provide uniformity of performance. These distances may be varied, in another implementation, if desired.

Figure 15:
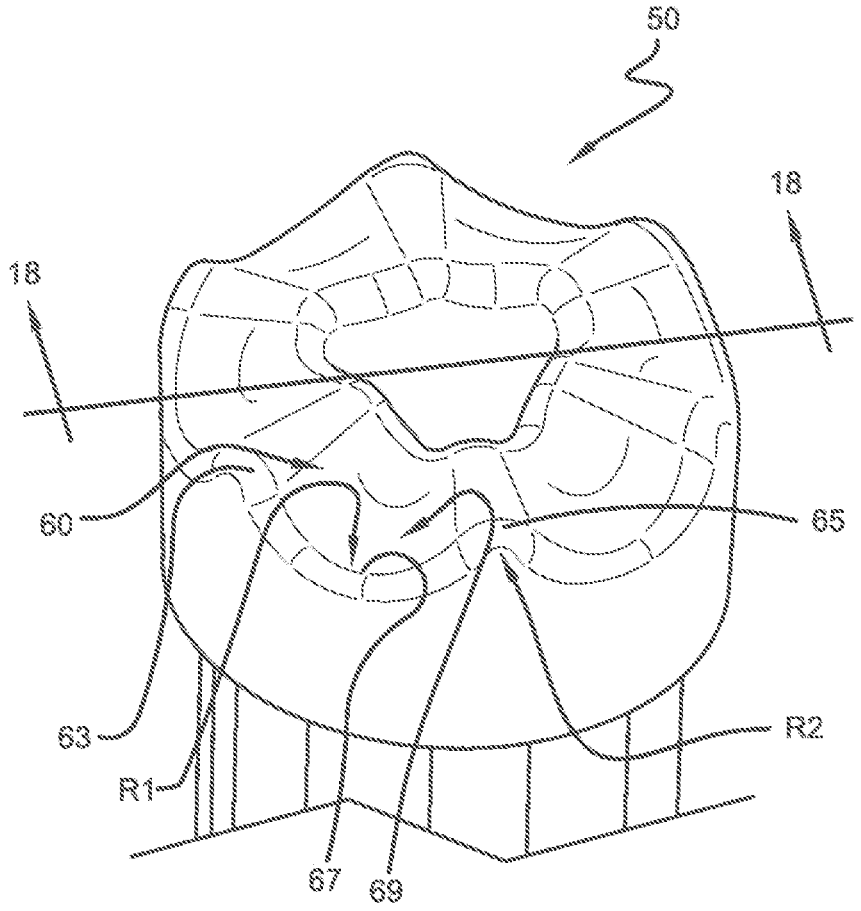
FIG. 15 is a top perspective view of an example implementation of a nock device.
Figure 16:
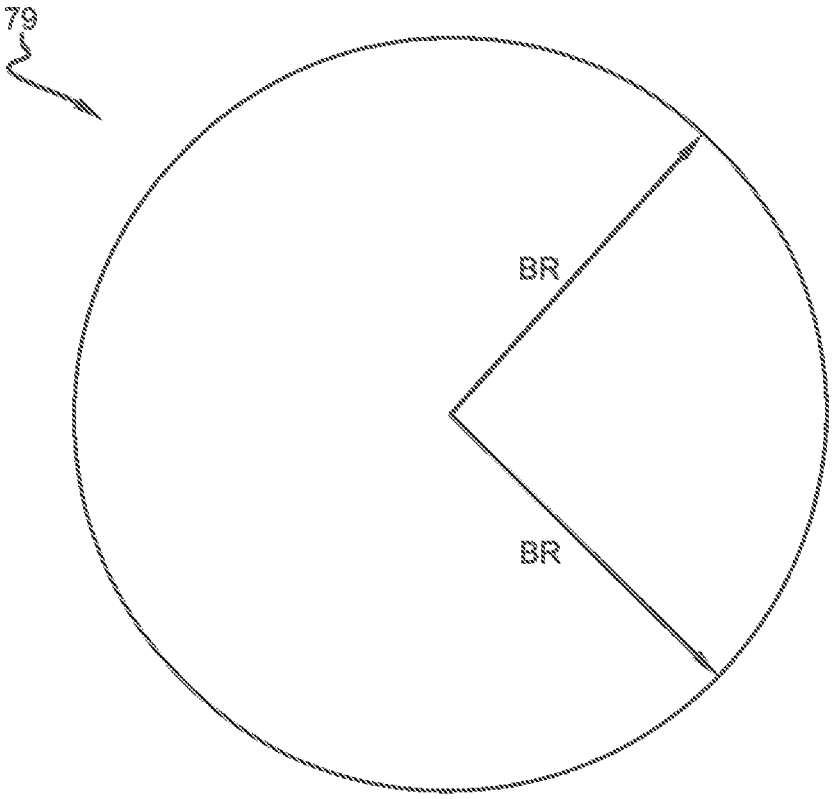
FIG. 16 is a sectional view of a bowstring.

With reference now to FIG. 15, in one implementation the bowstring contact surface 69 within the string guide impressions 60 may be substantially continuously curved from the first wall 63 through the second wall 67. In a more specific implementation, the bowstring contact surface 69 may be curved along a substantially constant radius R1. FIG. 16 is a cross section of a typical bowstring 79. The bowstring 79 is substantially circular in cross section having a radius BR. In one implementation, the radius R1 of the bowstring contact surface 69 is greater than or equal to two times the radius BR (2BR). This provides a good fit for the bowstring within the bowstring contact surface. In one specific implementation, the bowstring radius BR is approximately 0.075 inches and the radius R1 is approximately 0.18 inches. In one implementation, shown in FIG. 15, each wall 63, 65 may be positioned between string guide impressions 60. The wall peaks may be substantially continuously curved. In one implementation, the wall peaks may be curved along a substantially constant radius R2. In one specific implementation, the radius R2 may be approximately 0.03 inches.

Figure 1:
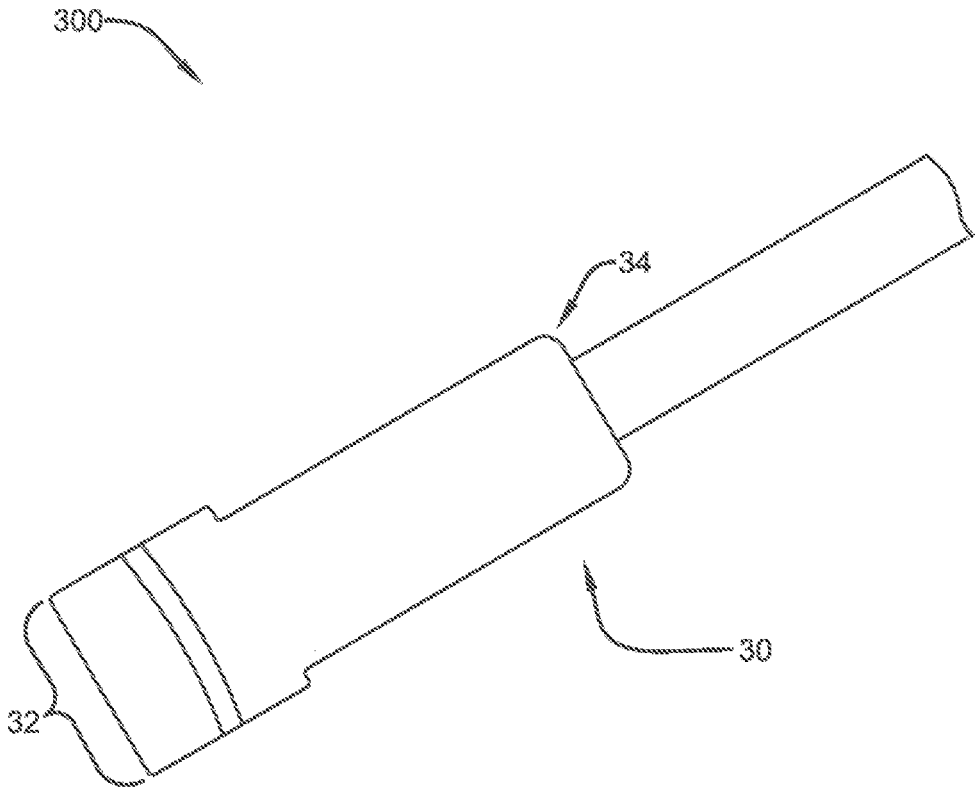
FIG. 1 PRIOR ART
FIG. 1 is a component diagram illustrating a perspective view of an example implementation of a nock.
Figure 17:
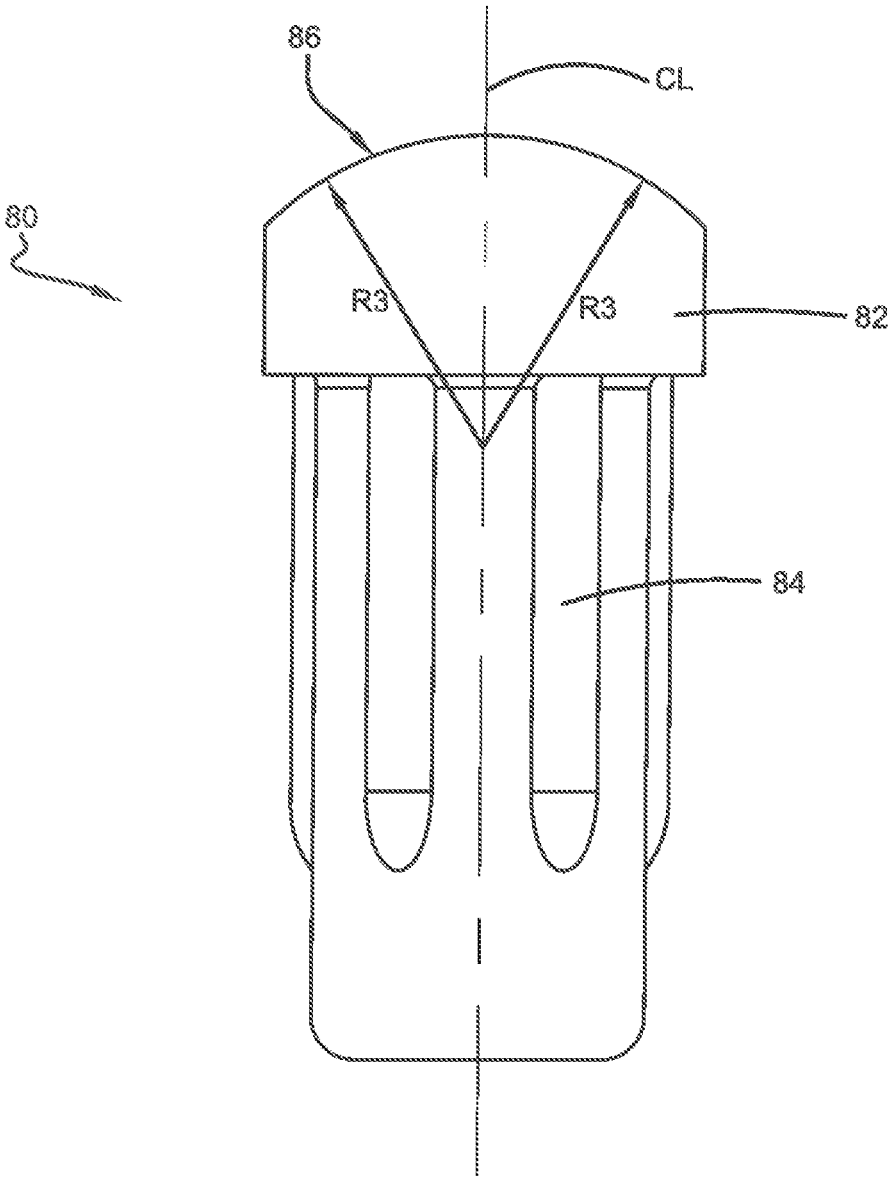
FIG. 17 is a component diagram illustrating a front solid view of an example implementation of a nock device.

With reference now to FIG. 17, in one implementation a nock device 80 may include a top portion 82 and an attachment surface 84 that is configured to attach the nock to an associated arrow. The top portion 82 may have an axial centerline CL and a bowstring contact surface 86 that is configured to receive an associated bowstring to fire the associated arrow. For the implementation shown, the contact surface 86 may be substantially continuously curved from its outer radial ends, or edges, outwardly toward the axial centerline CL. The top portion 82 is similar to the flat nock 30 discussed above (see FIG. 1) in that it allows various orientations of the arrow against the bowstring merely dependent on how the user decides to align the nock 80 on the bowstring. It differs from the flat nock 30, however, in that the curved surface 86 better engages the bowstring for firing the arrow. In a specific implementation, shown, the bowstring contact surface 86 may be curved along a substantially constant radius R3. The implementation shown in FIG. 17 provides a bowstring contact surface 86 that is partially spherical in shape with the portion at the axial centerline having the greatest outward extension and the contact surface 86 curving relatively downward in all directions from there. In one implementation, the radius R3 of the bowstring contact surface 86 is greater than or equal to two times the bowstring radius BR (2BR). In a more specific implementation, the radius R3 of the bowstring contact surface 86 is greater than or equal to three times the bowstring radius BR (3BR). In a more specific implementation, the radius R3 of the bowstring contact surface 86 is greater than or equal to four times the bowstring radius BR (3BR). In one specific implementation, the radius R3 may be approximately 0.34 inches.

Figure 18:
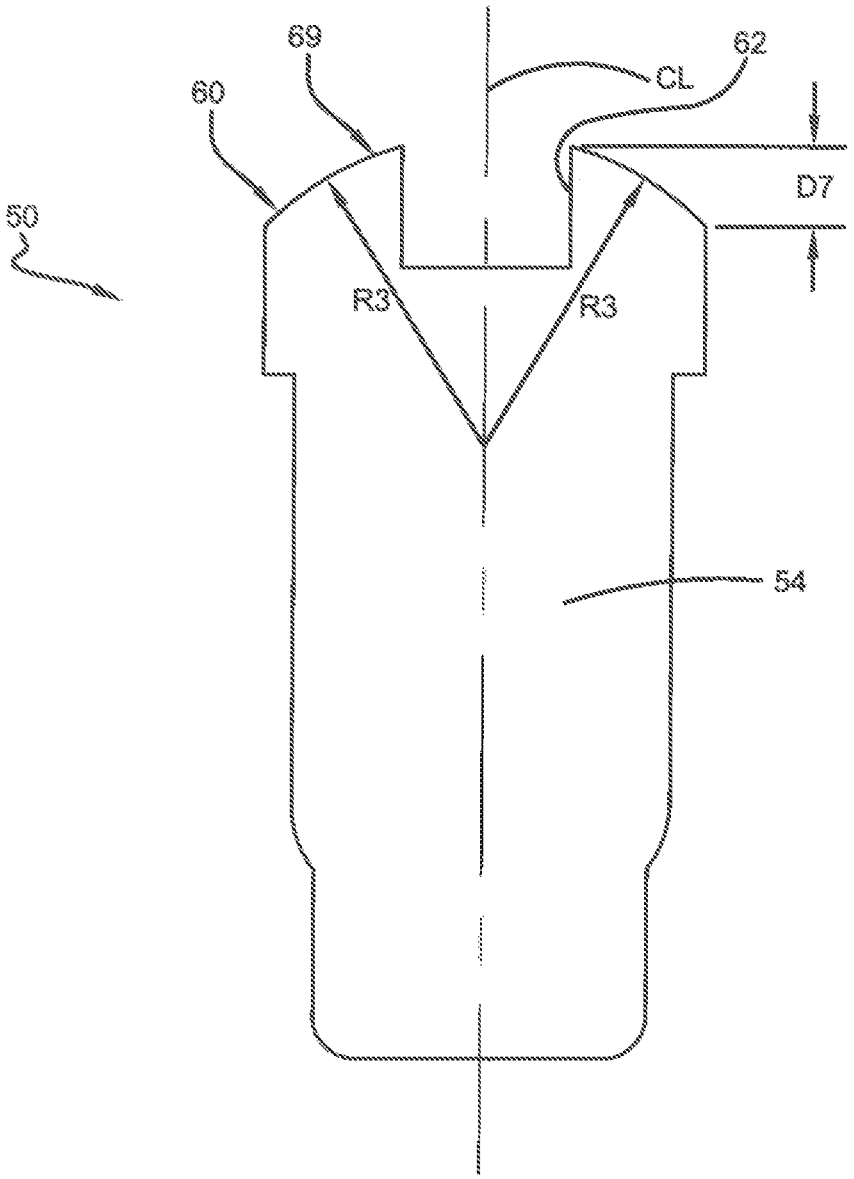
FIG. 18 is a sectional view along line 18-18 in FIG. 16.

FIG. 18 is a sectional view of FIG. 15 showing an implementation of a nock where the bowstring contact surface 69 is continuously curved from its outer radial ends, or edges, outwardly toward the axial centerline CL. Unlike the bowstring contact surface 86 shown in FIG. 17, the bowstring contact surface 69 is formed within the within the string guide impressions 60. In a specific implementation, shown, the bowstring contact surface 69 may be curved along a substantially constant radius R3. In one implementation, the radius R3 of the bowstring contact surface 69 is greater than or equal to two times the bowstring radius BR (2BR). In a more specific implementation, the radius R3 of the bowstring contact surface 86 is greater than or equal to three times the bowstring radius BR (3BR). In a more specific implementation, the radius R3 of the bowstring contact surface 86 is greater than or equal to four times the bowstring radius BR (3BR). In one specific implementation, the radius R3 may be approximately 0.34 inches. The distance D7 between the radially outer edge of the nock and the uppermost surface of the bowstring contact surface 69 may be approximately 0.03 inches.

Figure 3:
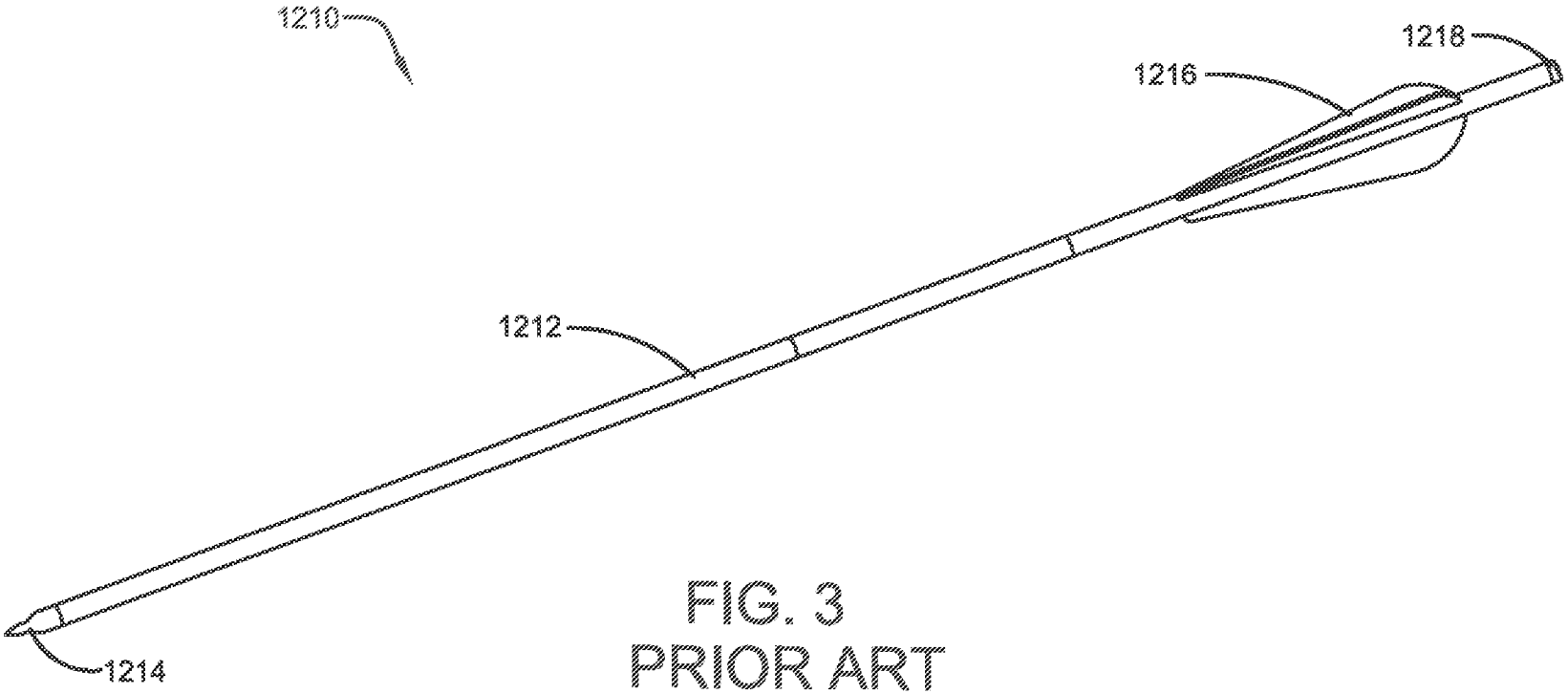
FIG. 3 PRIOR ART
FIG. 3 is a perspective view of a typical known arrow.
Figure 4A:
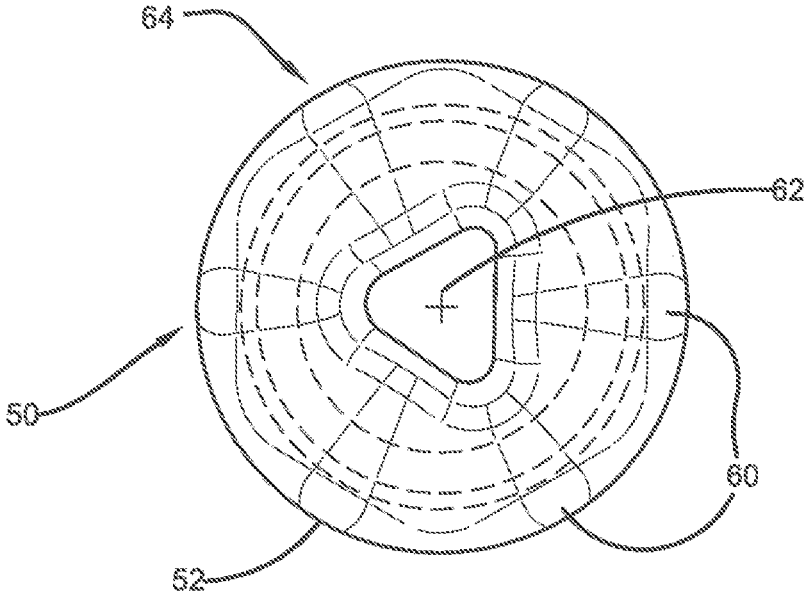
FIG. 4A is a component diagram illustrating a top view of an example implementation of a nock device.
Figure 4B:
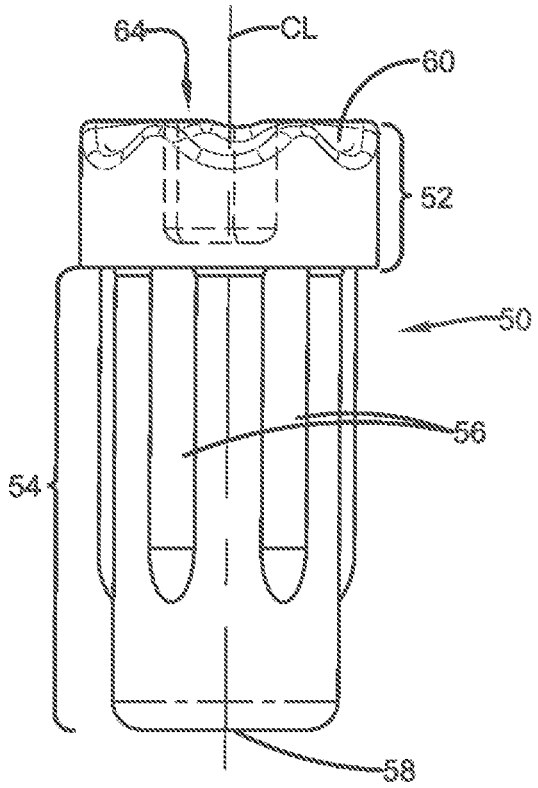
FIG. 4B is a component diagram illustrating a side view of an example implementation of a nock device.
Figure 4C:
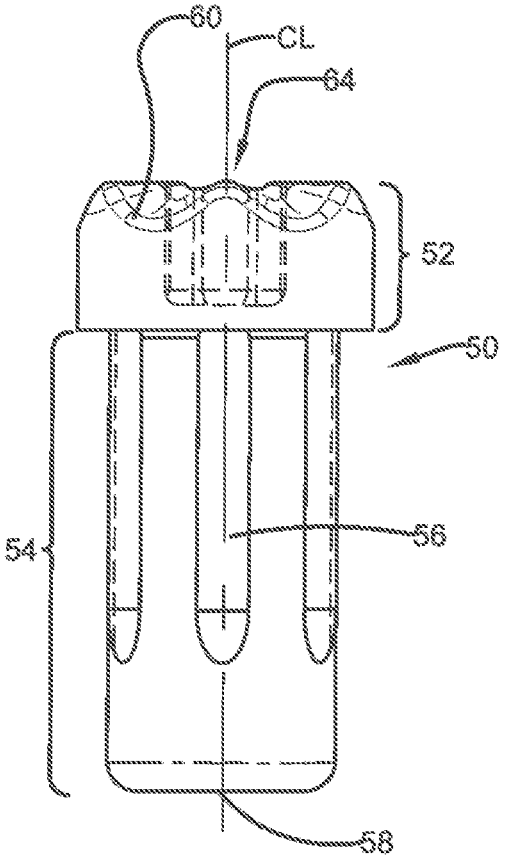
FIG. 4C is a component diagram illustrating a side view of an example implementation of a nock device.
Figure 19:
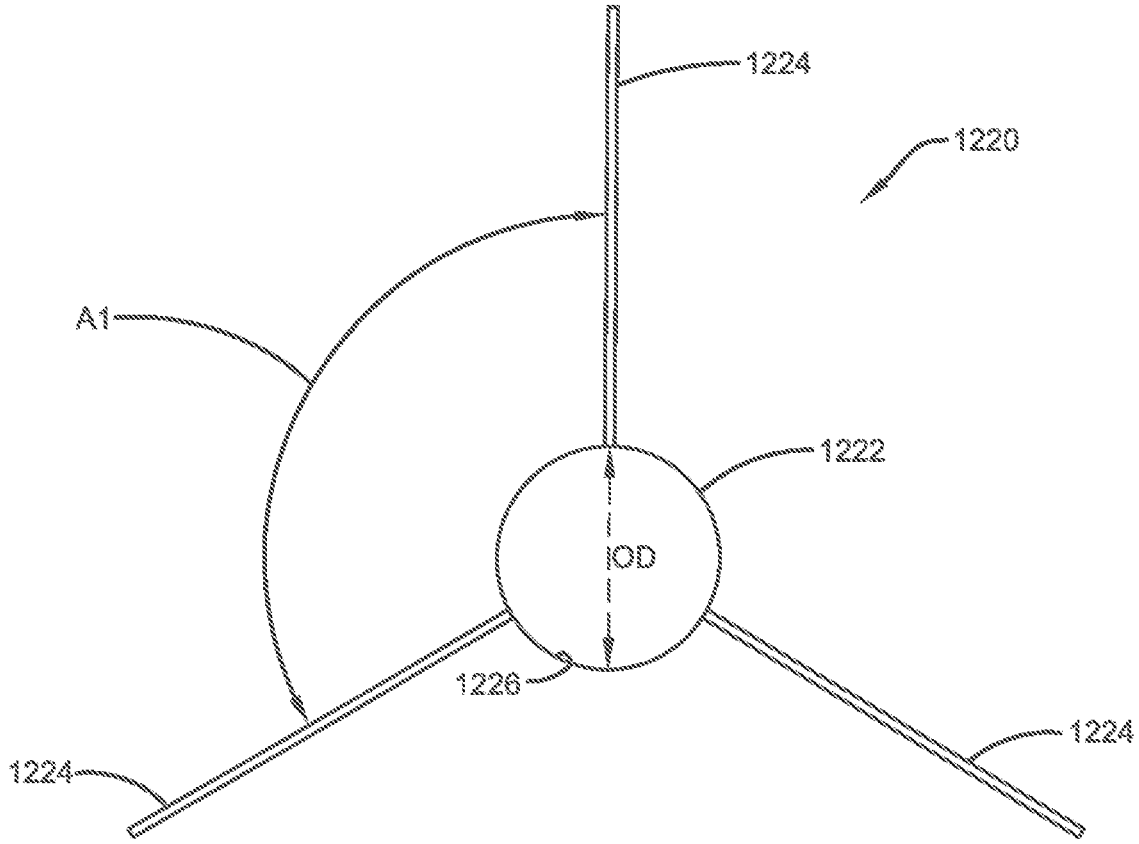
FIG. 19 is a back view of an arrow.

FIG. 19 shows the back end of an arrow 1220 which may be a typical known arrow. The arrow 1220 may have a body 1222, an arrow head (not shown but which may be similar to arrow head 1214 shown in FIG. 3) and vanes 1224. The back end of the body 1222 may have an outside diameter OD. This back end is the location on the arrow 1220 where a nock may be attached to the body 1222. The body 1222 may have a cylindrical opening 1226 which extends along the length of the arrow 1220 as is typical in arrows. The vanes 1224 may extend outwardly from the body 1222, as shown, and may have an angular orientation. For the embodiment shown, the angular orientation is an angle A1 between neighboring vanes 1224 of 120 degrees. This is typical for arrows as it provides desirable stabilization for the arrow 1220 when it is in flight. It should be noted, however, that this invention will work with any arrow chosen with the sound judgment of a person with skill in the art, including vanes having a different number of vanes and/or having a different angular orientation.

Figure 20:
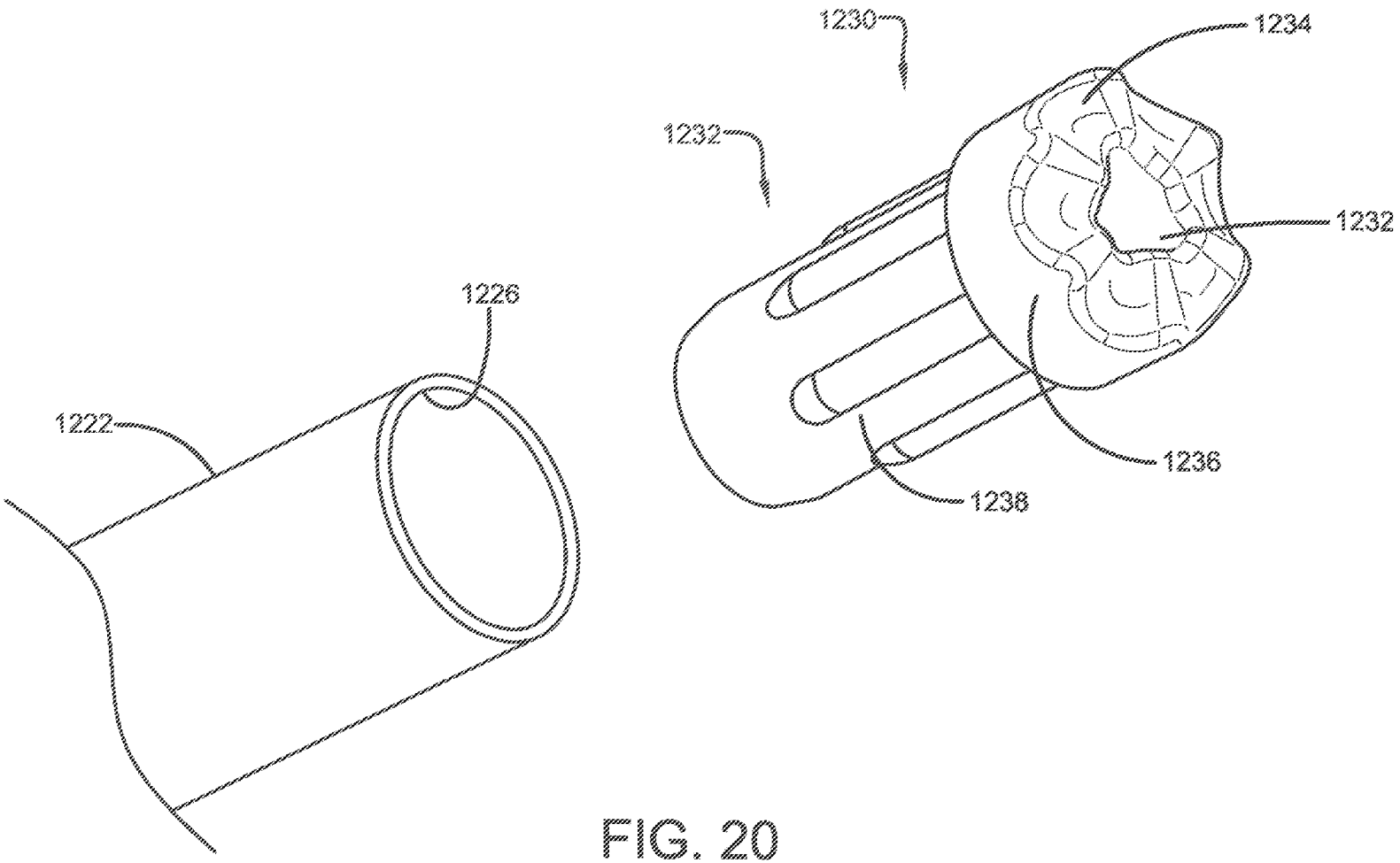
FIG. 20 is a side view of the back end of the arrow shown in FIG. 19 showing a nock according to some embodiments of this invention.

With reference now to FIGS. 19-20, a nock 1230 may be attached to the arrow 1220. The nock 1230 may have a connection surface 1232 that is connectable to the arrow body 1222 and a bowstring reception surface 1234 that is designed to receive the bowstring of a bow in order to propel or fire the arrow 1220. The nock 1230 may have a first end with an extension 1238 that defines the connection surface 1232 but it should be understood that this invention will work with nocks that connect to arrow bodies in other ways. The extension 1238 may have a generally cylindrical shape, as shown. The outer surface of the extension 1238 may be smooth, in one embodiment, or may have a textured surface as in the embodiment shown. To attach the nock 1230 to the arrow 1220, the extension 1238 may be inserted into the opening 1226 until a portion of a head 1236 opposite the bowstring reception surface 1234 contacts the back end of the arrow body 1222. The nock 1230 may be held in place by a friction fit or press fit between the extension 1238 and the surface of the arrow 1220 that defines the opening 1226 although other methods of holding the nock 1230 to the arrow 1220 may also work with this invention, such as using an adhesive.

Figure 22:
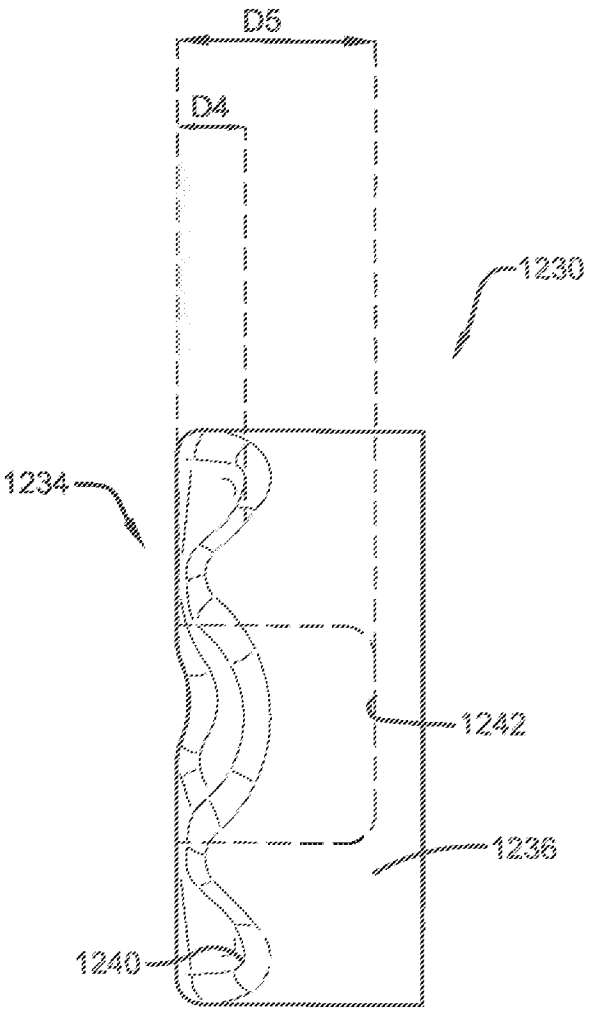
FIG. 22 is a side view of the nock head shown in FIGS. 19 and 20.
Figure 21:
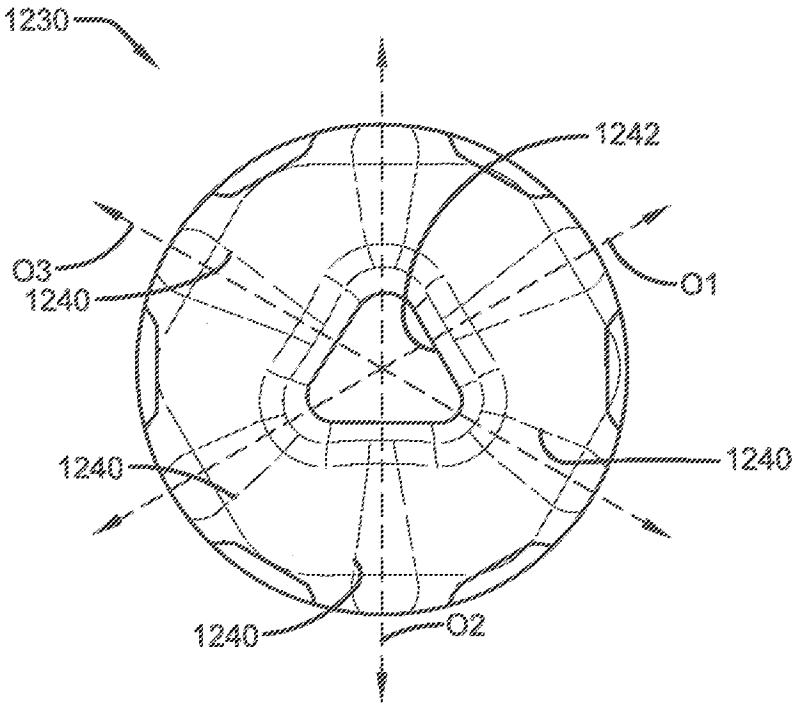
FIG. 21 is a front end view of the nock shown in FIG. 20.

With reference now to FIGS. 20-22, the nock 1230 may have a second end with the head 1236 upon which the bowstring reception surface 1234 is formed. The bowstring reception surface 1234 shown is designed to receive a bowstring in any one of three relative orientations, indicated with dashed lines O1, O2 and O3. It should be noted, however, that this invention will work with nocks having other bowstring reception surface designs. The bowstring reception surface 1234 may comprise pairs of grooves 1240 on opposite sides of an opening 1242 to form the three bowstring reception orientation options. The grooves 1240, and thus the bowstring reception surface 1234, extend inwardly a maximum distance D4. The opening 1242 extends inwardly a distance D5. Note that distance D5 is greater than distance D4. In one embodiment, the opening 1242 extends all the way through the length of the nock 1230.

With reference now to FIGS. 19-20 and 23-25, to properly align the nock 1230 with respect to the vanes 1224 on the arrow 1220, an alignment tool 1250 may be used. The alignment tool 1250 may have a body 1252 and a connection member 1254. The connection member 1254 may extend outwardly from the body 1252, as shown. The connection member 1254 may be shaped to be received within the opening 1242 in the nock 1230 so that once received within the opening 1242, rotation of the alignment tool 1250 will cause rotation of the nock 1230 with respect to the arrow 1220. In one embodiment, as seen best in FIG. 25, the outer surface of the connection member 1254 is generally triangular in shape having three planar portions 1256. Between the planar portions 1256, the outer surface may have curved portions 1258. The opening 1242 in the nock 1230, as seen best in FIG. 24 may have a matching shape with planar portions 1260 and curved portions 1262. While a triangular shape has advantages that will be described below, it should be understood that the connection member 1254 and opening 1242 can have any design chosen with the sound judgment of a person of skill in the art that permits rotation of the alignment tool 1250 to cause rotation of the nock 1230.

Figure 23:
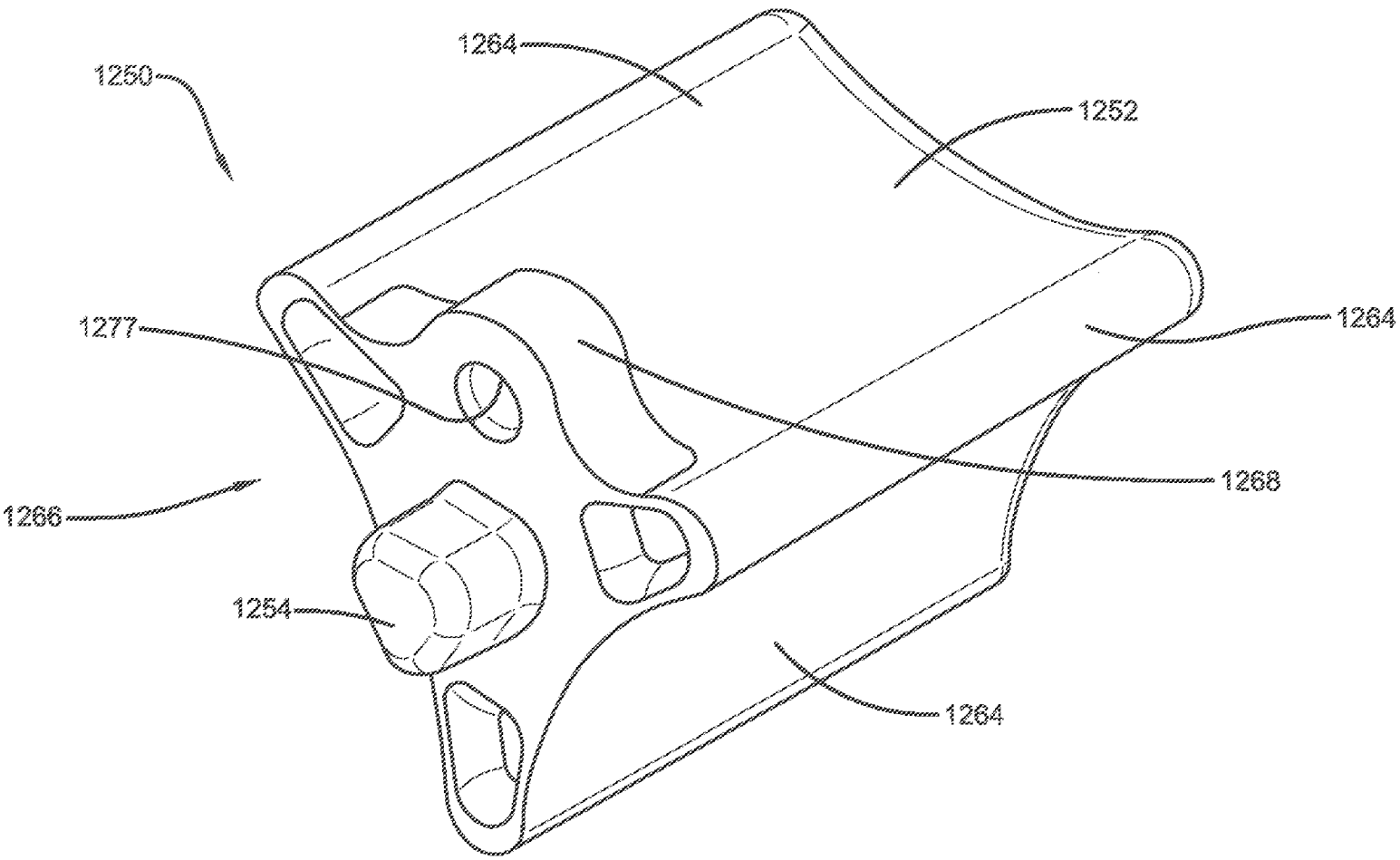
FIG. 23 is a perspective end view of an alignment tool according so some embodiments of this invention.

With reference now to FIG. 23, the attachment of the connection member 1254 to the body 1252 can be in any manner chosen with the sound judgment of a person of skill in the art. In one embodiment, the connection member 1254 is made integrally, as one piece, with the body 1252. In another embodiment, the connection member 1254 can be selectively attached and detached from the body 1252. In this case, a worn connection member 1254 could be removed from the body 1252 and a new connection member 1254 could be added in its place. It is also contemplated to provide different connection members 1254 having different sizes and/or shapes to correspond with different nocks. In this case, a connection member of one size and/or shape could be removed from the body 1252 and replaced with a connection member of another size and/or shape.

With reference now to FIGS. 23 and 26-29, the body 1252 of the alignment tool 1250 may have any shape and size chosen with the sound judgment of a person of skill in the art. The body 1252 may have at least two indicating surfaces 1264 that are spaced around the outer surface of the alignment tool body 1252 at a relative angular orientation that matches the angular orientation of the vanes 1224 on the arrow body 1222. In one embodiment, shown, there are three indicating surfaces 1264 to match the number of vanes 1224 on the typical arrow. For the embodiment shown, there is an angular orientation of 120 degrees, see angle A2 in FIG. 27, between the indicating surfaces 1264 to match the 120 degree angular orientation of the vanes 1224 on the arrow 1220, as shown in FIG. 19. It should be understood, however, that the alignment tool body 1252 can be designed to have indicating surfaces at any angular orientation to match the angular orientation of the vanes on an arrow. The indicating surfaces 1264 can take any form chosen with the sound judgment of a person of skill in the art. In one embodiment, the indicating surfaces 1264 are markings or indicia applied to the outer surface of the alignment tool body 1252. For the embodiment shown, the indicating surfaces 1264 are surfaces that extend or project outwardly from the alignment tool body 1252. In one embodiment, the indicating surfaces 1264 have an angular orientation that matches the connection member 1254. In one specific embodiment, as seen best in FIG. 27, the indicating surfaces 1264 have an angular orientation that matches the curved portions 1258 of the connection member 1254. In an alternate embodiment, the indicating surfaces 1264 could be positioned to have an angular orientation that matches the planar portions 1256 of the connection member 1254.

Figure 27:
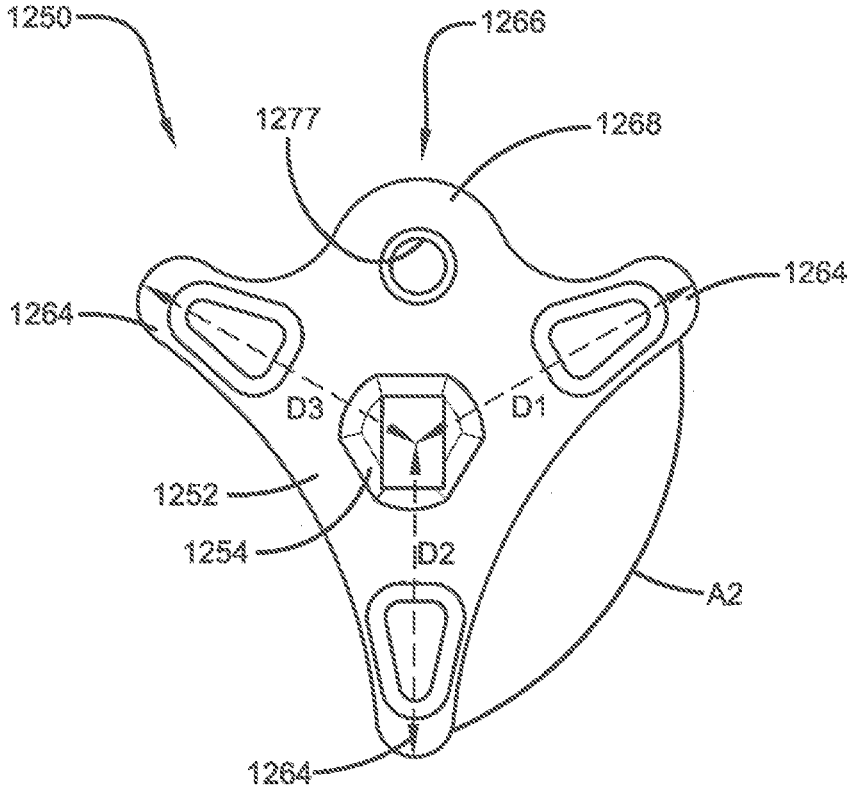
FIG. 27 is an end view of the alignment tool taken along line 27-27 in FIG. 26.
Figure 28:
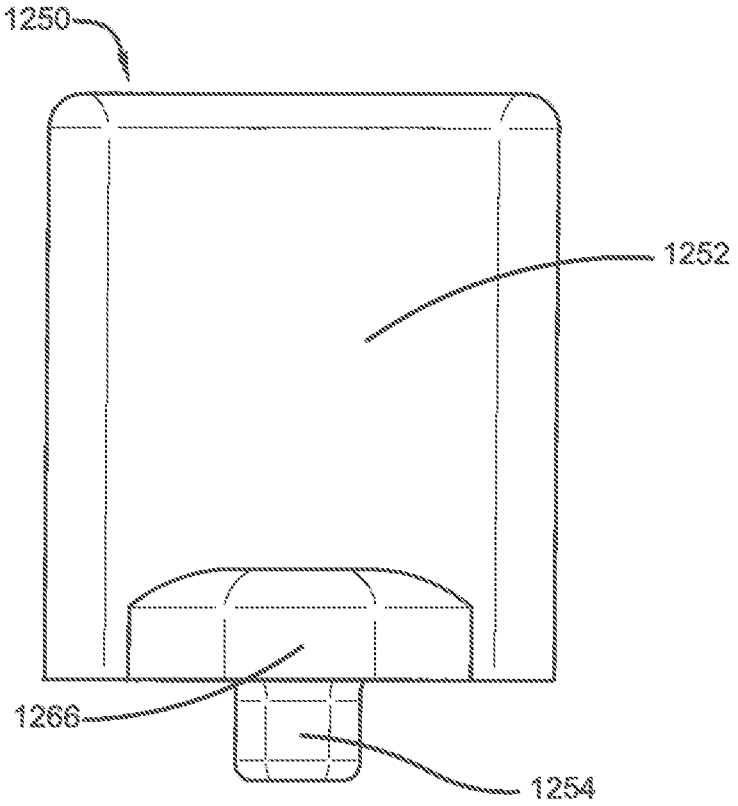
FIG. 28 is a top view of the alignment tool shown in FIG. 23.
Figure 29:
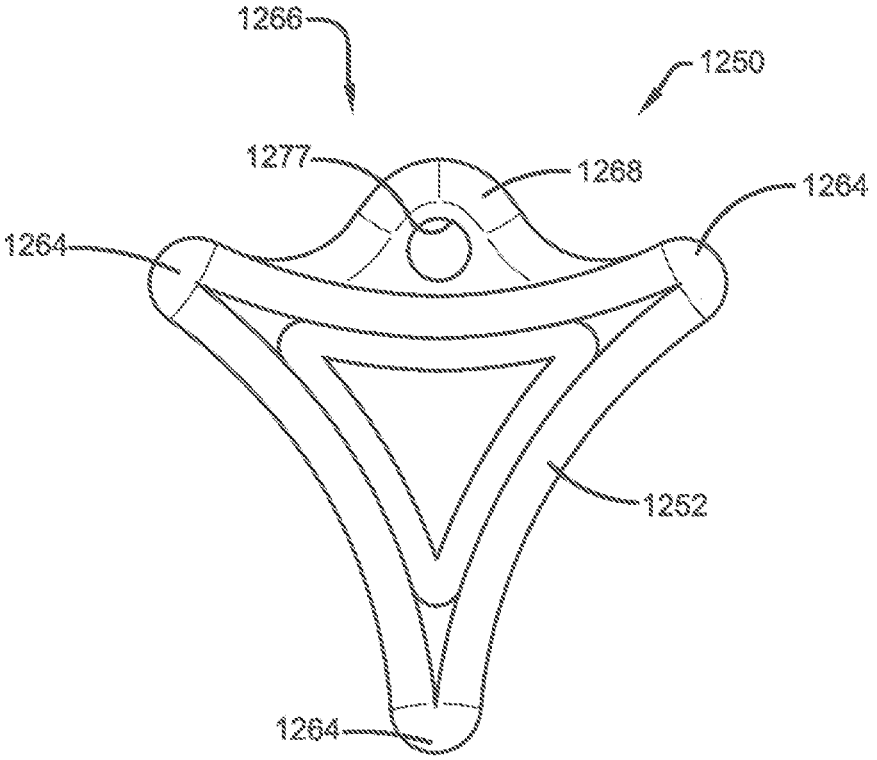

With continuing reference to FIGS. 23 and 26-29, the indicating surfaces 1264 may be spaced from a longitudinal axis LA of the connection member 1254. FIG. 27 shows three indicating surfaces 1264 spaced distances D1, D2 and D3 from the longitudinal axis LA. It should be noted that for the embodiment shown, distances D1, D2 and D3 are greater than the outside diameter OD, shown in FIG. 19, of the back end of the arrow body 1222. The embodiment shown also provides that distances D1, D2 and D3 are equal to each other but in another embodiment they are not equal. The outer surface of the alignment tool body 1252 may extend inwardly between the indicating surfaces 1264. For the embodiment shown, the outer surface of the alignment tool body 1252 extends inwardly along a curved surface between the indicating surfaces 1264.

Still referring to FIGS. 23 and 26-29, the alignment tool 1250 may also have an attachment surface 1266. The attachment surface 1266 may be used to attach the alignment tool 1250 to another object for safe keeping. The alignment tool 1250 may, for example, be attached to a bow. For another example, the alignment tool 1250 may be attached to a user's key chain or the like. While the attachment surface 1266 may have any shape and size chosen with the sound judgment of a person of skill in the art, for the embodiment shown the attachment surface 1266 includes an extension surface 1268 that extends from the body 1252 and an opening 1277.

To use the alignment tool 1250, shown in FIG. 23, with the nock 1230, shown in FIGS. 20-22, the user may begin with the arrow 1220 as shown in FIG. 19. The user may then attach the nock 1230 to the arrow 1220. In one embodiment, this is done by inserting the nock extension 1238 into the arrow opening 1226, as described above and shown in FIG. 20. The alignment tool 1250 may then be attached to the nock 1230. Alternatively, the user may attach the alignment tool 1250 to the nock 1230 and then attach the nock 1230 to the arrow 1220. To attach the alignment tool 1250 to the nock 1230, the user simply inserts the connection member 1254 into the opening 1242. To make this insertion, with reference to FIGS. 24-25, the planar portions 1256 of the connection member 1254 are juxtaposed to the planar portions 1260 in the nock opening 1242 and the curved portions 1258 of the connection member 1254 are juxtaposed to the curved portions 1262 in the nock opening 1242. Because, in the embodiment shown, there are three juxtaposed planar portions and three juxtaposed curved portions, there are three relative orientations where the alignment tool 1250 can be received in the opening 1242. All three work equally well, provided that the bowstring reception surface 1234 is designed to receive a bowstring in any one of three relative orientations, as discussed above.

With reference now to FIGS. 20-23, once the alignment tool 1250 has been attached to the nock 1230, the nock 1230 may be inserted into the opening 1226 in the arrow 1220 as described above (unless the nock 1230 has already been inserted). FIG. 45 shows the alignment tool 1250 attached to the nock 1230 and the nock 1230 attached to the arrow 1220. To then align the nock 1230 with respect to the vanes 1224 on the arrow 1220, it is only necessary to rotate the alignment tool 1250, and thus the nock 1230, with respect to the arrow 1220 until the indicating surfaces 1264 are aligned with respect to the vanes 1224. With this invention, alignment can be quickly and easily seen by the user. This is shown, for example, in FIG. 46. It should be noted, however, that while proper alignment for the embodiment shown occurs when the indicating surfaces 1264 and vanes 1224 have the same angular orientation, in other embodiments proper alignment may occur when the indicating surfaces 1264 and vanes 1224 have different angular orientations (though they may maintain the same relative angular orientation, such as 120 degrees, for example). As an example of this embodiment, FIG. 45 might show proper alignment. All that is necessary is that the indicating surfaces 1264 be properly aligned with respect to the vanes 1224 for any particular application. Once proper alignment has been achieved, the user can easily remove the alignment tool 1250 from the arrow 1220 by removing the connection member 1254 from the nock opening 1242.

In another embodiment, a nock may be lighted. By "lighted" it is meant that a light source may illuminate the nock when activated so that the user can see the arrow after it has been shot. FIGS. 31-32, show the components of a lighted nock assembly 1270 according to some embodiments of this invention. The lighted nock assembly 1270 may include a nock 1272, an LED-battery combination component 1274, and an insert 1276. The LED-battery combination component 1274 may, in one embodiment, be activated by applying a compression force to the LED-battery combination component 1274.

With reference now to FIGS. 30-37, the nock 1272 may have a connection surface 1280 that is connectable to the insert 1276 and a bowstring reception surface 1282 that is designed to receive a bowstring. For the embodiment shown, the nock 1272 may have a first end with an extension that defines the connection surface 1280 but it should be understood that this invention will work with nocks that connect to inserts in other ways. The extension may have a generally cylindrical shape, as shown. The outer surface of the extension may be smooth, in one embodiment, or may have a textured surface in another embodiment. For the embodiment shown, the outer surface of the extension may have slots 1286, as shown. The extension may have an opening 1288. The opening 1288 may communicate with an opening 1284, as shown. In one embodiment, the outer surface of the extension is generally triangular in shape having three planar portions 1290 connected by three curved portions 1292. The purpose for this shape will be discussed further below. The nock 1272 may have a second end with a head 1278 upon which a bowstring reception surface 1282 is formed. The bowstring reception surface 1282 may be designed to receive a bowstring in any one of three relative orientations, as described above, but this invention will work with nocks having other bowstring reception surface designs. The opening 1284 may be formed in the head 1278, as shown.

With reference now to FIGS. 19-20, 30-31 and 38-43, the insert 1276 may have a connection surface 1296 that is connectable to the arrow body 1222 and an opening 1298. The insert 1276 may have a first end with an extension that defines the connection surface 1296 but it should be understood that this invention will work with inserts that connect to arrow bodies in other ways. The extension may have a generally cylindrical shape, as shown. The outer surface of the extension may be smooth, in one embodiment, or may have a textured surface in another embodiment. For the embodiment shown, the outer surface of the extension may have ribs 104 that extend longitudinally, as shown. While five ribs 104 are shown, any proper number of ribs could be used. The extension may have an opening 106 that communicates with the opening 1298 which may be formed in a head 1294, as shown. The end of the extension opposite the head 1294 may have a wall 108 that encloses the extension. To attach the insert 1276 to the arrow 1220, the extension may be inserted into the opening 1226 until an edge of the head 1294 closest to the extension contacts the back end of the arrow body 1222. The insert 1276 may be held in place by a friction fit between the extension and the surface of the arrow 1220 that defines the opening 1226 although other methods of holding the insert 1276 to the arrow 1220 may also work with this invention.

With reference now to FIGS. 38-43, the opening 1298 in the head 1294 of the insert 1276 may match the connection member 1254 of the alignment tool 1250 (shown in FIG. 23). In another embodiment, shown, the opening 1298 also matches the outer surface of the extension of the nock 1272 (shown in FIG. 32). In one specific embodiment, as seen best in FIG. 38, the opening 1298 may have a matching triangular shape. Specifically, the opening 1298 may have three planar portions 100 and three curved portions 102. This design permits the extension of the nock 1272, and thus the nock 1272, to be insertable into the insert 1276 in at least one, three shown, specific relative positions.

Figure 25:
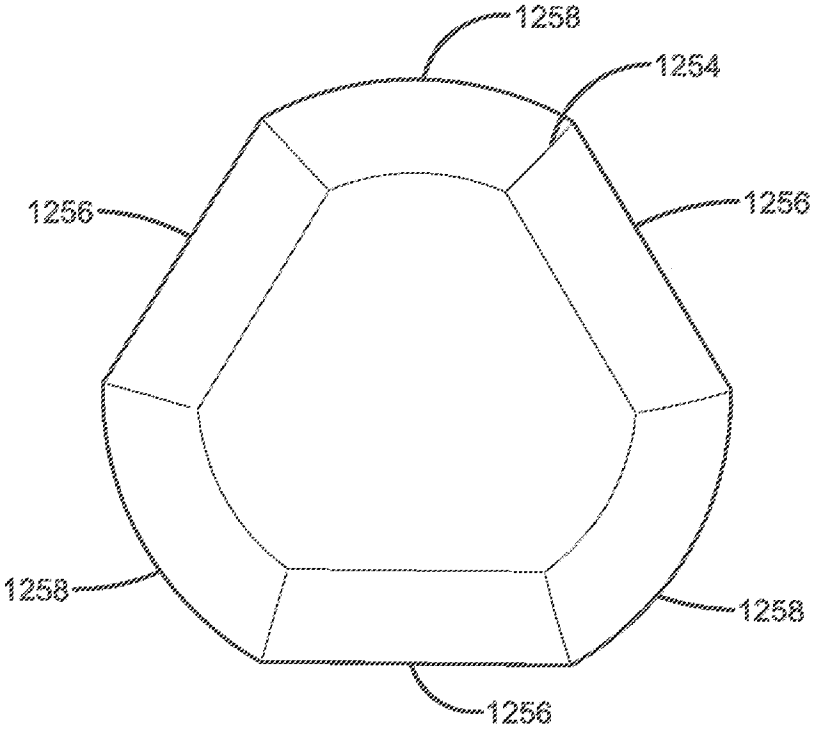
FIG. 25 shows the shape of the connection member shown in FIG. 23.
Figure 24:
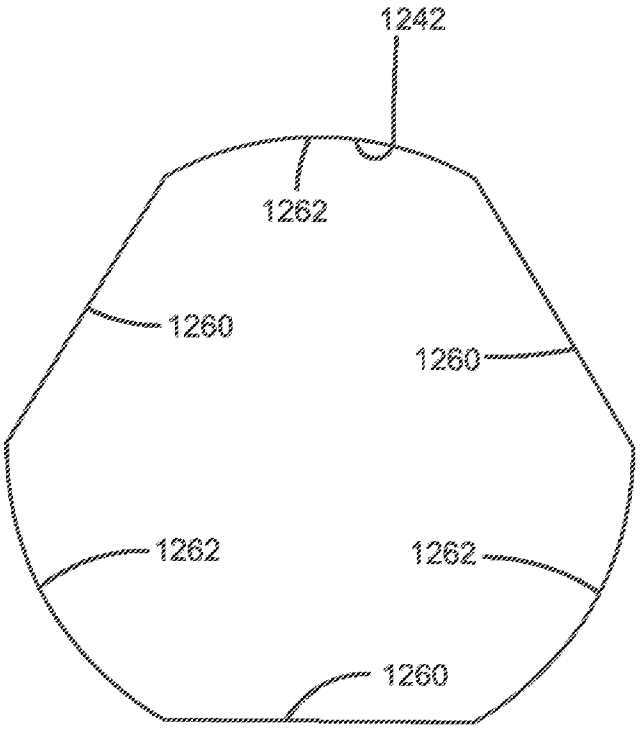
FIG. 24 shows the shape of the opening in the nock shown in FIGS. 20-22.
Figure 26:
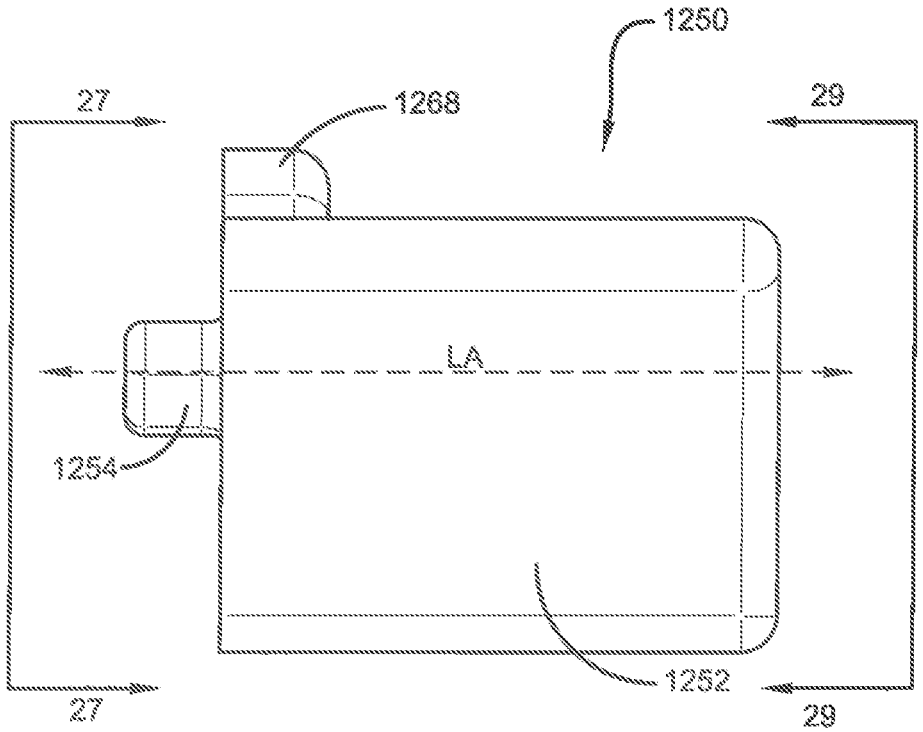
FIG. 26 is a side view of the alignment tool shown in FIG. 23.

To use the alignment tool 1250, shown in FIG. 23, with the lighted nock assembly 1270, shown in FIGS. 30-31, the user may begin with the arrow 1220 as shown in FIG. 19. The user may first insert the insert 1276 into the arrow opening 1226. More specifically, the insert extension may be inserted into the opening 1226 in the arrow 1220 in the same manner as the nock extension 1238, shown in FIG. 20, as described above and shown in FIG. 47. The alignment tool 1250 may then be attached to the insert 1276. Alternatively, the user may attach the alignment tool 1250 to the insert 1276 and then insert the insert 1276 into the arrow 1220. To attach the alignment tool 1250 to the insert 1276, the user simply inserts the connection member 1254 into the opening 1298 in the head 1294, as seen best in FIGS. 38 and 42. To make this insertion the planar portions 1256 of the connection member 1254, shown in FIG. 25, are juxtaposed to the planar portions 100 in the insert opening 1298, shown in FIG. 42, and the curved portions 1258 of the connection member 1254 are juxtaposed to the curved portions 102 in the insert opening 1298. Because, in the embodiment shown, there are three juxtaposed planar portions and three juxtaposed curved portions, there are three relative orientations where the alignment tool 1250 can be received in the opening 1298. All three work equally well. FIG. 48 shows the alignment tool 1250 attached to the insert 1276 and the insert 1276 attached to the arrow 1220. Once the alignment tool 1250 has been attached to the insert 1276, the insert 1276 may be inserted into the opening 1226 in the arrow 1220 as described above (unless the insert 1276 has already been inserted). To then align the insert 1276 with respect to the vanes 1224 on the arrow 1220, it is only necessary to rotate the alignment tool 1250, and thus the insert 1276, with respect to the arrow 1220 until the indicating surfaces 1264 are aligned with respect to the vanes 1224. With this invention, alignment can be quickly and easily seen by the user. This is shown, for example, in FIG. 49. In some embodiments, the opening 1277 may be used as a reference hole that is aligned with a cock vane (not shown). As with the nock noted above, alignment of the insert 1276 with respect to the vanes 1224 may vary depending on application. Once proper alignment has been achieved, the user can easily remove the alignment tool 1250 from the arrow 1220 by removing the connection member 1254 from the insert opening 1298.

The LED-battery combination component 1274, shown in FIG. 31, may then be inserted into the opening 1288, shown in FIGS. 34-35, in the nock 1272. In one embodiment, the LED-battery combination component 1274 has an outer surface 110, at least part of which may be held in place by a friction fit or press fit with inner surface 112 of the nock opening 1288. It should be noted, however, that other methods of holding the LED-battery combination component 1274 to the nock 1272 may also work with this invention. The nock 1272 and LED-battery combination component 1274 may then be simultaneously inserted into the openings 1298 and 106 in the insert 1276, shown in FIGS. 41-42, with the result shown in FIG. 30. Note that for the embodiment shown, the nock head 1278 remains outside the insert 1276 when the notch extension is inserted into the insert opening 1298. Note also that for the embodiment shown in FIG. 30, a gap D6, which may be about the thickness of a dime, is maintained between the head 1278 of the nock 1272 and the end of the insert 1276 to prevent the LED from illuminating before it is desired. To make this insertion the planar portions 1290 of the nock 1272, shown in FIG. 37, are juxtaposed to the planar portions 100 of the insert opening 1298, shown in FIG. 42, and the curved portions 1292 of the nock 1272 are juxtaposed to the curved portions 102 in the insert opening 1298. Because, in the embodiment shown, there are three juxtaposed planar portions and three juxtaposed curved portions, there are three relative orientations where the nock 1272 can be received in the opening 1298. All three work equally well for the nock 1272 as its contact surface 1282, as seen best in FIG. 36, provides three bowstring reception areas that can be used to receive and contact the bowstring, as shown. In this way, the nock 1272 is aligned both with respect to the insert 1276 and with respect to the vanes 1224 on the arrow 1220. When the lighted nock assembly 1270 is attached to an arrow and the arrow is fired, the bowstring will contact the nock 1272 closing the gap D6 and causing the LED to illuminate.

With reference now FIGS. 28-31 and 34-35, if it is desired to remove the nock 1272 from the insert 1276, the user can simply grip the head 1278 of the nock 1272 and pull it out of the insert openings 1298, 106. If the LED-battery combination component 1274 was press fit or otherwise attached to the nock 1272, removing the nock 1272 from the insert 1276 will simultaneously remove the LED-battery combination component 1274 from the insert 1276. The LED-battery combination component 1274 can then be easily removed from the nock 1272 by pulling it out of the nock opening 1288, if desired.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

When the word "associated" is used in the claims, the intention is that the object so labeled is not positively claimed but rather describes an object with which the claimed object may be used.

Having thus described the invention, it is now claimed:

1. A method comprising the steps of:

(A) providing a nock with: (1) a circumference; (2) an attachment surface; and (3) a top portion having an axial centerline and first, second and third distinct string guide impressions;

(B) providing each string guide impression with two circumferentially spaced walls separated by a floor that is curvilinear in shape;

(C) providing each wall with: (1) an axially extending peak that is curvilinear in shape; and (2) first and second circumferentially spaced sides that are curvilinear in shape;

(D) providing the nock to be useful with an associated arrow having a longitudinal axis and an associated bow having a bowstring; and (E) providing the nock to be operable to perform the following steps: (1) connecting the attachment surface to the associated arrow and aligning the nock with respect to the associated arrow; and (2) contacting the associated bowstring to any surface on the top portion of the nock;

wherein step (E)(2) comprises the steps of: (1) contacting a curvilinear surface of the nock with the associated bowstring; and (2) positioning the associated bowstring within at least one of the string guide impressions to fire the associated arrow.

2. The method of claim 1 wherein:

step (A)(3) comprises the step of: providing the top portion with a fourth distinct string guide impression;

step (A) further comprises the steps of: providing the first string guide impression and the second string guide impression on opposite ends of a first bisecting line of the top portion; providing the third string guide impression and the fourth string guide impression on opposite ends of a second bisecting line of the top portion; and step (E)(2) comprises the step of: positioning the associated bowstring within one of: the first and second string guide impressions; and, the third and fourth string guide impressions.

3. The method of claim 1 wherein step (E)(2) comprises the step of:

causing the associated arrow to rotate about its longitudinal axis with respect to the associated bow.

4. The method of claim 1 wherein:

step (B) comprises the step of: providing each floor with a concave shape facing a first axial direction; and step (C) comprises the step of: providing each peak with a convex shape facing the first axial direction.

5. The method of claim 1 wherein step (A) further comprises the step of:

providing the top portion with a slot positioned on the axial centerline.

6. The method of claim 1 wherein:

step (C) comprises the step of: providing each peak to be curved along a substantially constant first radius; and step (B) comprises the step of: providing each floor to be curved along a substantially constant second radius that is greater than the first radius.

7. The method of claim 1 wherein:

step (D) comprises the step of: providing the bowstring to have a first radius; and step (B) comprises the step of: providing each floor to be curved along a substantially constant second radius that is greater than the first radius.

8. A method comprising the steps of:

(A) providing a nock with: (1) a circumference; (2) an attachment surface; and (3) a top portion having an axial centerline and first, second and third distinct string guide impressions;

(B) providing each string guide impression with two circumferentially spaced walls separated by a floor;

(C) providing each wall with: (1) an axially extending peak; and (2) first and second circumferentially spaced sides that are curvilinear in shape;

(D) providing the nock to be useful with an associated arrow having a longitudinal axis and an associated bow having a bowstring with a circular cross-section; and (E) providing the nock to be operable to perform the following steps: (1) connecting the attachment surface to the associated arrow and aligning the nock with respect to the associated arrow; and (2) receiving a portion of the associated bowstring within at least one of the string guide impressions to fire the associated arrow;

wherein step (E)(2) comprises the steps of: (1) contacting the corresponding floor with the associated bowstring; and (2) simultaneously extending the associated bowstring axially beyond the corresponding wall peaks.

9. The method of claim 8 wherein:

step (A)(3) comprises the step of: providing the top portion with a fourth distinct string guide impression;

step (A) further comprises the steps of: providing the first string guide impression and the second string guide impression on opposite ends of a first bisecting line of the top portion; providing the third string guide impression and the fourth string guide impression on opposite ends of a second bisecting line of the top portion; and step (E)(2) comprises the step of: positioning the associated bowstring within one of: the first and second string guide impressions; and, the third and fourth string guide impressions.

10. The method of claim 8 wherein step (E)(2) comprises the step of:

causing the associated arrow to rotate about its longitudinal axis with respect to the associated bow.

11. The method of claim 8 wherein step (B) comprises the step of:

providing the floor to extend into the nock a distance of about 0.04 inches.

12. The method of claim 8 wherein step (A) further comprises the step of:

providing the top portion with a slot positioned on the axial centerline.

13. The method of claim 12 further comprising the steps of:

providing the floor to extend into the nock a first distance; and providing the slot to extend into the nock a second distance that is greater than the first distance.

* * * * *